US008783461B2

(12) United States Patent
Hill et al.

(10) Patent No.: US 8,783,461 B2
(45) Date of Patent: Jul. 22, 2014

(54) COLLAPSIBLE BULK BIN CONTAINER

(75) Inventors: John Benjamin Hill, Chicago, IL (US); David Fred Kari, Bloomingdale, IL (US)

(73) Assignee: International Paper Co., Memphis, TN (US)

( * ) Notice: Subject to any disclaimer, the term of this patent is extended or adjusted under 35 U.S.C. 154(b) by 390 days.

(21) Appl. No.: 13/111,552

(22) Filed: May 19, 2011

(65) Prior Publication Data

US 2011/0308993 A1 Dec. 22, 2011

Related U.S. Application Data

(60) Provisional application No. 61/346,123, filed on May 19, 2010.

(51) Int. Cl.
*B65D 19/00* (2006.01)
*B65D 19/20* (2006.01)

(52) U.S. Cl.
CPC ..... *B65D 19/20* (2013.01); *B65D 2519/00597* (2013.01); *B65D 2519/00054* (2013.01); *B65D 2519/00019* (2013.01); *B65D 2519/00343* (2013.01); *B65D 2519/00124* (2013.01); *B65D 2519/0092* (2013.01); *B65D 2519/00557* (2013.01); *B65D 2519/00796* (2013.01); *B65D 2519/00159* (2013.01); *B65D 2519/00447* (2013.01); *B65D 2519/00288* (2013.01); *B65D 2519/00323* (2013.01); *B65D 2519/00641* (2013.01); *B65D 2519/00378* (2013.01); *B65D 2519/00194* (2013.01); *B65D 2519/00711* (2013.01); *B65D 2519/00089* (2013.01); *B65D 2519/00273* (2013.01)
USPC ..... 206/600; 108/51.3

(58) Field of Classification Search
CPC ..... B65D 19/20; B65D 2519/00019; B65D 2519/00054
USPC ..... 206/600, 386; 108/51.11, 51.3, 56.1, 108/57.22; 220/4.09
See application file for complete search history.

(56) References Cited

U.S. PATENT DOCUMENTS 3,026,015 A * 3/1962 Severn ..... 206/600
3,434,435 A * 3/1969 Achermann et al. ..... 108/51.3
3,519,190 A * 7/1970 Achermann et al. ..... 206/599
3,911,834 A * 10/1975 Quaintance ..... 108/51.3

(Continued)

*Primary Examiner* — Mickey Yu
*Assistant Examiner* — Rafael Ortiz
(74) *Attorney, Agent, or Firm* — Matthew M. Eslami

(57) ABSTRACT

A collapsible shipping container is capable of configured from a collapsed position for storage and transportation to a constructed position for containment of articles therein and back again to the collapsed position after use. The collapsible shipping container comprises a foldable tray having at least two pallet runner sleeves spaced apart from one another and each of which being formed on respective opposed lateral edges of the foldable tray. A plurality of elongated pallet runners each of which having an inner support structure integrally formed thereto. The plurality of elongated pallet runners each of which is adapted to be inserted into each of the respective plurality of pallet runner sleeves. A foldable side wall body is adapted to rest upon the foldable tray to form an interior space to receive a plurality of articles. The foldable side wall body comprises end walls, side walls, and side body flaps to form an enclosed bottom thereof. Each of the end walls includes an articulation fold formed therein so that during the collapsed position, the articulation folds move toward the interior space and during the constructed position, the articulation folds move away from the interior space. A lid is configured to telescopically enclosing the collapsible shipping container.

13 Claims, 28 Drawing Sheets

(56) References Cited

U.S. PATENT DOCUMENTS

| | | | | |
|---|---|---|---|---|
| 4,119,205 | A * | 10/1978 | Delany | 206/598 |
| 4,373,637 | A | 2/1983 | Shippell | |
| 4,969,559 | A | 11/1990 | Nederveld | |
| 5,301,872 | A * | 4/1994 | Tusing et al. | 229/117.03 |
| 5,318,219 | A | 6/1994 | Smith | |
| 5,921,187 | A * | 7/1999 | Wang | 108/51.3 |
| 6,050,410 | A * | 4/2000 | Quirion | 206/386 |
| 7,128,209 | B2 | 10/2006 | Bringard et al. | |
| 7,290,664 | B2 * | 11/2007 | Kono et al. | 206/600 |
| 7,513,365 | B2 | 4/2009 | Cornelius et al. | |
| 7,597,194 | B2 | 10/2009 | Oberliesen et al. | |
| 2006/0076255 | A1 * | 4/2006 | Bragadeste et al. | 206/386 |
| 2006/0102517 | A1 * | 5/2006 | Chen | 206/600 |
| 2009/0308289 | A1 * | 12/2009 | Ferguson | 108/51.3 |

* cited by examiner

COLLAPSIBLE BULK BIN CONTAINER

CROSS REFERENCE TO RELATED APPLICATIONS

This application claims priority to U.S. provisional patent application Ser. No. 61/346,123, filed on 19 May 2010, which is hereby incorporated hereinto by reference as if fully restated herein.

FIELD OF THE INVENTION

This invention relates to shipping containers, and more particularly to corrugated paperboard containers that may be shipped in a collapsed or knocked-down state and easily assembled into a larger container for use and being disassembled for re-use.

BACKGROUND OF THE INVENTION

Corrugated paperboard containers are commonly used to store and transport a variety of goods. Many of these containers are quite large, holding from 500 to 2,000 pounds or more of product, and typically are placed on pallets so that the containers may be handled with forklifts or jack trucks and the like. Wooden pallets are used in most conventional systems. These pallets are strong but they also are relatively heavy and expensive and are difficult to transport or recycle after use. Moreover, containers that are stacked upon but not fastened to the pallet may become displaced during handling, thereby causing the forklift operator to waste valuable time in rearranging the containers on the pallet. In extreme cases, the containers may actually fall off the pallet, causing damage to or destruction of the goods being transported.

To avoid these problems, integrated container and pallet constructions have been developed in the prior art. In these constructions the bottom of the container is configured to have a pallet integrated into it, with outboard runners of the pallet extending along the outer side edges of the container, and openings inboard of the outboard runners for receiving the tines of a forklift. Conventional containers of this type usually are dimensioned to fit on a standard 40 inch by 48 inch pallet, and the tines of a forklift normally are set so that they extend through the openings inboard of the outermost runners. One problem with such containers is the ability to ship the containers in an unassembled or knock-down flattened condition, to reduce initial shipping costs due to its size, while providing the ability to set up such containers at the customer destination or other end user. Another problem is to store, destroy or otherwise handle wooden pallets.

Therefore, it would be desirable to have a collapsible bulk bin container that can be shipped in a knocked-down flattened condition or collapsed condition and as a single contained unit. Further, it would be desirable to have such a container that can be easily and quickly set up at the user's facility and that could be knocked down or disassembled upon completion of the use.

SUMMARY OF THE INVENTION

Some of the advantages of the collapsible bulk bin container of the present invention are as follows: the collapsible bulk bin container is a complete bulk bin kit including a bulk bin, a corrugated pallet and an integrated lid. There is no need for additional lid components or wooden pallets. The collapsible or knock-down flattened condition bulk bin folds from the knock down position to the open position easily and quickly. The knock-down bulk bin is completely recyclable (when comprised of the standard corrugated components). The collapsible or knock-down bulk bin can be stacked and stored efficiently in a warehouse when in the knocked down configuration. The knock-down position can also provide convenient and efficient returnable packaging for customers. The knock-down bulk bin can include various "kit" items i.e.: bags, corner boards, partitions, pads etc. depending on a customer's needs. The knock down pallet can also be shipped internationally without having to meet lumber treatment codes as there is no wood in the design.

Accordingly, one aspect of the present invention is directed to a collapsible container comprising a foldable tray having a plurality of pallet runner sleeves. A plurality of elongated pallet runners each of which is adapted to be removably inserted into each of the respective plurality of pallet runner sleeves. A foldable side wall body is adapted to rest upon the foldable tray to form an interior space to receive a plurality of articles. A lid is telescopically enclosing the collapsible container. The foldable tray comprises a plurality of fork access openings formed therein to accommodate the tines of a forklift. The plurality of fork access openings are in both opposed side walls of the foldable tray for a two-way entry of the tines of a forklift. The plurality of pallet runner sleeves includes two pallet runner sleeves spaced apart from one another and are integrally formed on respective opposed lateral edges of the foldable tray. Each of the plurality of elongated pallet runners includes an inner support structure integrally formed thereto to enhance lateral strength of each of the plurality of elongated pallet runners. The plurality of elongated pallet runners includes three pallet runners wherein two of which are inserted to the respective plurality of pallet runner sleeves and one of the three pallet runners is disposed in proximity of center of the foldable tray. Both opposed ends of each of the plurality of elongated pallet runners are enclosed. The foldable side wall body comprises end walls, side walls, and side body flaps to form an enclosed bottom thereof and wherein each of the end walls includes an articulation fold formed therein to bisect the respective end wall panels. The foldable side wall body is attached to the foldable tray via an attachment flap. The foldable sidewall body sits inside peripheral boundaries of the foldable tray having a minimum profile. The foldable tray, the plurality of elongated pallet runners, and the foldable side wall body are all formed from corrugated paperboard material.

Another aspect of the present invention is directed to a collapsible shipping container is capable of configured from a collapsed position for storage and transportation to a constructed position for containment of articles therein and back again to the collapsed position after use. The collapsible shipping container comprises a foldable tray having at least two pallet runner sleeves spaced apart from one another and each of which being formed on respective opposed lateral edges of the foldable tray. A plurality of elongated pallet runners each of which having an inner support structure integrally formed thereto. The plurality of elongated pallet runners each of which is adapted to be inserted into each of the respective plurality of pallet runner sleeves. A foldable side wall body is adapted to rest upon the foldable tray to form an interior space to receive a plurality of articles. The foldable side wall body comprises end walls, side walls, and side body flaps to form an enclosed bottom thereof. Each of the end walls includes an articulation fold formed therein so that during the collapsed position, the articulation folds move toward the interior space and during the constructed position, the articulation folds move away from the interior space. A lid is configured to telescopically enclosing the collapsible shipping container.

One further aspect of the present invention is directed to a method for constructing a collapsible shipping container. The method comprising the steps of forming a foldable tray made from a blank B4. The foldable tray has a base wall panel, two side wall panels, and two end wall panels which are formed by two pairs of respective fold lines intersecting one another at right angles. Two pallet runner sleeves are formed between the base wall panel and the two opposed end wall panels. Then, forming a plurality of elongated pallet runners each of which made from a blank B1, the plurality of elongated pallet runners being affixed to the foldable tray, the plurality of elongated pallet runners includes an inner support structure integrally formed thereto and forming a foldable side wall body made from a blank B3, the foldable side wall body configured to be attached to the foldable tray to form an interior space to receive a plurality of articles wherein the foldable side wall body comprises two end walls, two side walls, and side body flaps to form an enclosed bottom thereof wherein each of the end walls includes an articulation fold formed therein so that during the collapsed position, the articulation folds move toward the interior space and during the constructed position, the articulation folds move away from the interior space.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE INVENTION

Figure 1:
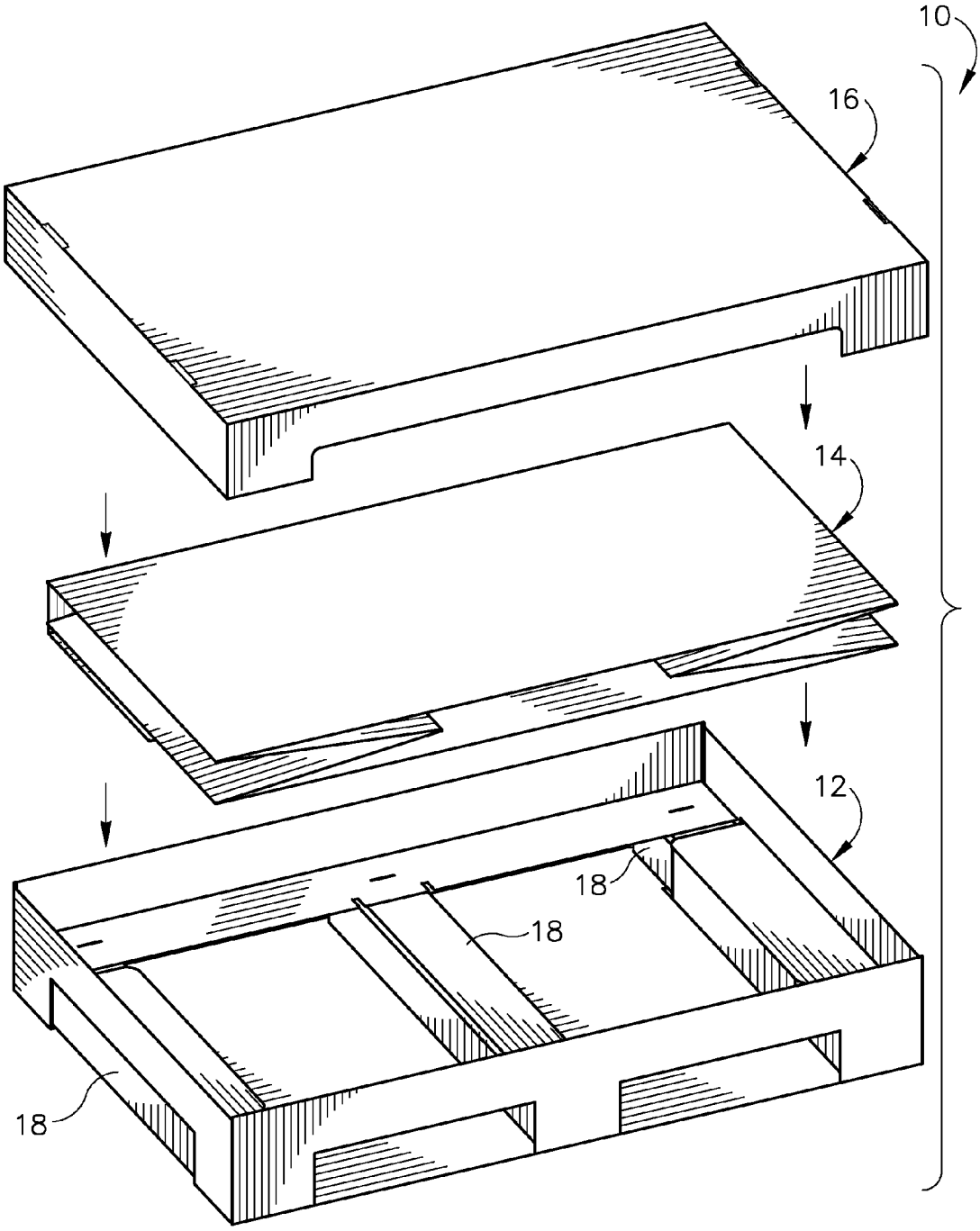
FIG. 1 is an exploded perspective view of collapsible bulk bin container in the collapsed configuration in accordance to a preferred embodiment of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. In the present invention the use of prime character in the numeral references in the drawings directed to the different embodiment indicate that those elements are either the same or at least function the same.

With reference to FIG. 1, a collapsible bulk bin container assembly 10 according to a preferred embodiment of the present invention includes a tray 12, a sidewall body 14, and a lid 16. A plurality of elongated pallet runners 18 are attached to the tray 12. The tray 12 including the elongated pallet runners 16, the sidewall body 14, and the lid 16 collectively defines a collapsible bulk bin container kit, which is sized sufficiently to contain articles therein for shipment and/or storage. The tray 12, sidewall body 14, and the pallet runners 18 are respectively sized so that the pallet runners 18 can support the weight of the articles shipped and/or stored therein. The sidewall body 14 and the pallet runners 18 may be adhered or otherwise affixed, either permanently or removably to the tray 12. For example, adhesives, glues, staples, nails, straps, or the like, may be used to couple sidewall body 14, and the pallet runners 16 to the tray 12 as will be described in greater detail below. The collapsible bulk bin container 10 is adapted to be stacked on one or more of the same collapsible bulk bin container 10.

Figure 2:
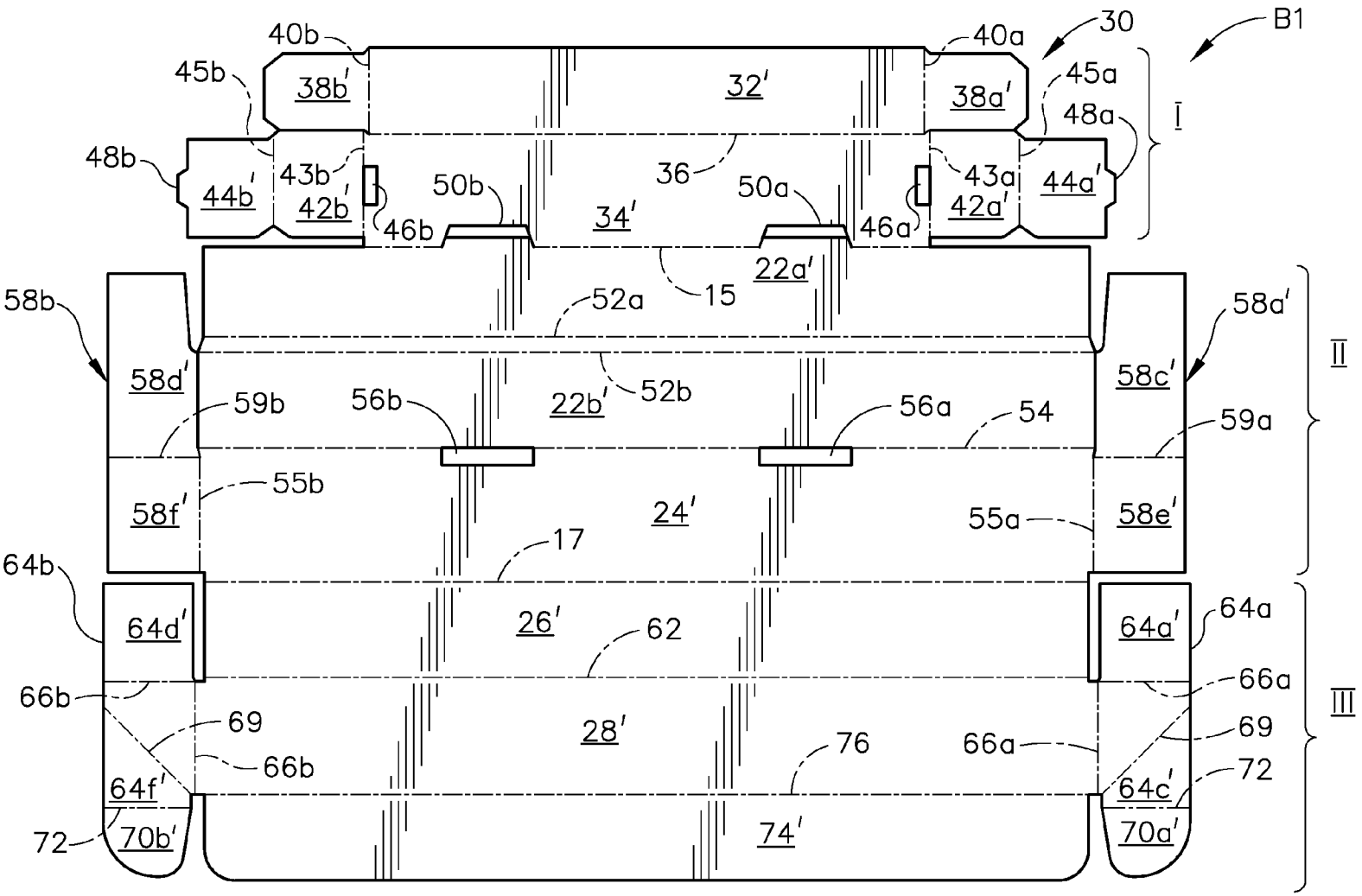
FIG. 2 is a top plan view of a blank B1 for making a pallet runner for use in the collapsible bulk bin container in accordance to a preferred embodiment of the present invention.

FIG. 2 is a top plan view of a blank B1 for making the pallet runner 18 for use in the collapsible bulk bin container 10 in accordance to a preferred embodiment of the present invention. The blank B1 is substantially flat symmetrical with respect to its lateral axis and preferably is an integral piece of a material such as continuous sheet of conventional corrugated paperboard. The blank B1 is cut along its outer margins to form its specific shape. The blank B1 is defined by three sections I, II, and III by two substantially parallel first and second fold lines 15 and 17, respectively. Section I forms an inner support structure 30 of the pallet runner 18 when the section I is in the folded position. Section II forms a first double side wall panels 22*a*', 22*b*' and a bottom wall panel 24' of the pallet runner 18 when the section II is fully constructed. Section III forms a second side wall panel 26' and a top wall panel 28' when the section III is fully constructed.

The inner support structure 30 includes respective first and second panels 32', 34' defined by a third fold line 36. The first panels 32' includes respective opposed first and second flaps 38*a*, 38*b* defined by respective fold lines 40*a*, and 40*b* and extend outwardly from respective lateral edges thereof. Respective third and fourth flaps 42*a*', 42*b*' foldably joined from respective lateral edges of the second panel 34'. The respective third and fourth flaps 42*a*', 42*b*' are defined by respective fold lines 43*a*, 45*a* and 43*b*, 44*b*. In addition, respective fifth and sixth flaps 44*a*, 44*b* is foldably joined to respective third and fourth flaps 42*a*', 42*b*'. The respective fifth and sixth flaps 44*a*, 44*b* is defined by respective fold lines 45*a*, 45*b*. Respective first and second slots 46*a*, 46*b* are formed on the panel 34' and each of which are located in proximity of the respective fold lines 43*a*, 43*b*. Each of the fifth and sixth flaps 44*a*, 44*b* includes respective first and second tabs 48*a*, 48*b* extends from respective free edges. The first and second locking tabs 48*a*, 48*b* are engaged with the corresponding first and second slots 46*a*, 46*b* when the first, second flaps 38*a*, 38*b*, third and fourth flaps 42*a*', 42*b*', fifth and sixth flaps 44*a*, 44*b* are in folding and overlapping relationship with one another. In addition, respective third and fourth locking tabs 50*a*, 50*b* are formed on longitudinal edge of the panel 34' in proximity of the fold line 15. The third and fourth tabs 50*a*, 50*b* are spaced apart from one another and are engaged with respective third and fourth slots 56*a*, 56*b* when the inner support structure 20 is fully constructed. The inner support structure 30, when constructed, resembles a tray shape which is used as reinforcing and enhances the lateral strength of the pallet runner 18.

As noted above, section II forms a first double side wall panels 22*a*', 22*b*' and a bottom wall panel 24' of the pallet runner 18 when the section II is fully constructed. The first double side wall panels 22*a*', 22*b*' are defined by two substantially parallel fold lines 52*a*, 52*b* and the bottom wall panel 24' is defined by fold lines 54 and 17. The first double side wall panels 22*a*', 22*b*', when folded at right angle with respect parallel fold lines 52*a*, 52*b*, form a gap 78 between the side wall panels 22*a*', 22*b*' so that section III can be foldably engaged with section II during construction of the pallet runner as will be described in greater detail herein below. The bottom wall 24' includes first and second front roll minor flaps 58*a*, 58*b* that are foldably joined on the respective lateral edges thereof and are defined by fold lines 55*a*, 55*b*, respectively. Each of the first and second front rolls minor flaps 58*a*, 58*b* are foldably divided by a respective fold line 59*a*, 59*b* into first long flaps 58*c*, 58*d* and first short flaps 58*e*, 58*f*. The first long flaps 58*c*, 58*d* are engaged with the inner support structure 20 when they are in fully folded position and they are configured to be perpendicular to the respective first short flaps 58*e*, 58*f*. In this position, the short flaps 58*e*, 58*f* forms the end walls 60*a*, 60*b* of the pallet runner 18. Section III comprises of the second side wall panel 26' and a top wall panel 28' which is defined by fold line 62. The top wall 28' includes first and second rear roll minor flaps 64*a*, 64*b* that are foldably joined on the respective lateral edges thereof and are defined by fold lines 66*a*, 66*b*, respectively. Each of the first and second rear rolls minor flaps 64*a*, 64*b* are foldably divided by a fold lines 66*a*, 66*b* into second long flaps 64*c*, 64*d* and second short flaps 64*e*, 64*f*. Each of the second long flaps 64*c*, 64*d* includes a respective locking tabs 70*a*, 70*b* defined by respective fold lines 72*a*, 72*b*. Fold lines 69 are formed on each of the second long flaps 64*c*, 64*d* to permit bending the second long flaps 64*c*, 64*d* during construction of the pallet runner 18. The top wall 28' includes a tuck flap 74 define by a fold line 76.

FIGS. 3A-3E illustrates folding sequences of the blank B1 shown in FIG. 2 for constructing the pallet runner 18. It should be noted that the proper size and configuration of these panels are important to construct sections I, II, and III that are brought into juxtaposition with one another to form the pallet runner 18 as fully constructed in FIG. 4.

Figure 3A:
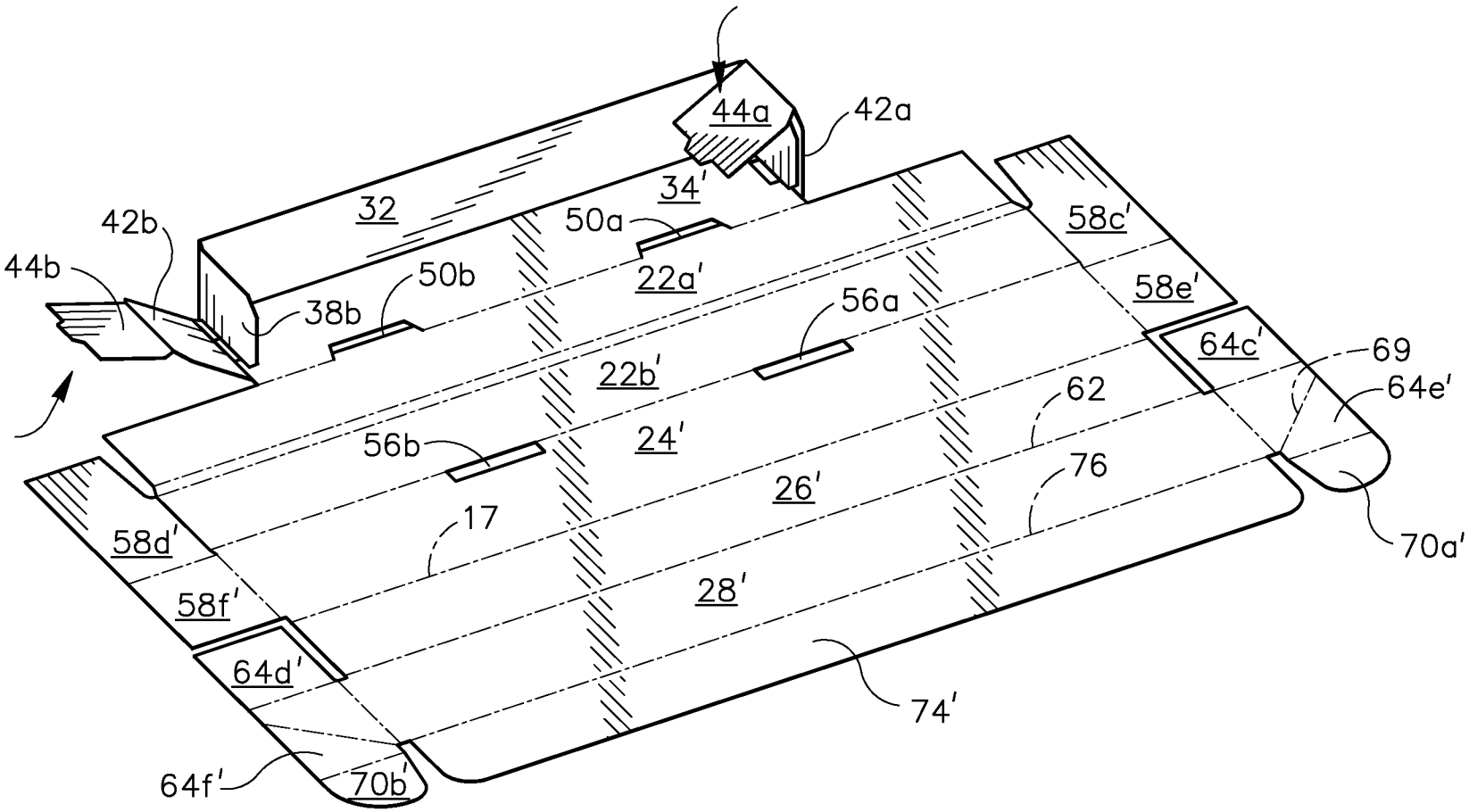
FIGS. 3A-3E illustrates the folding sequences of the blank B1 shown in FIG. 1 for constructing the pallet runner in accordance to the present invention.
Figure 3B:
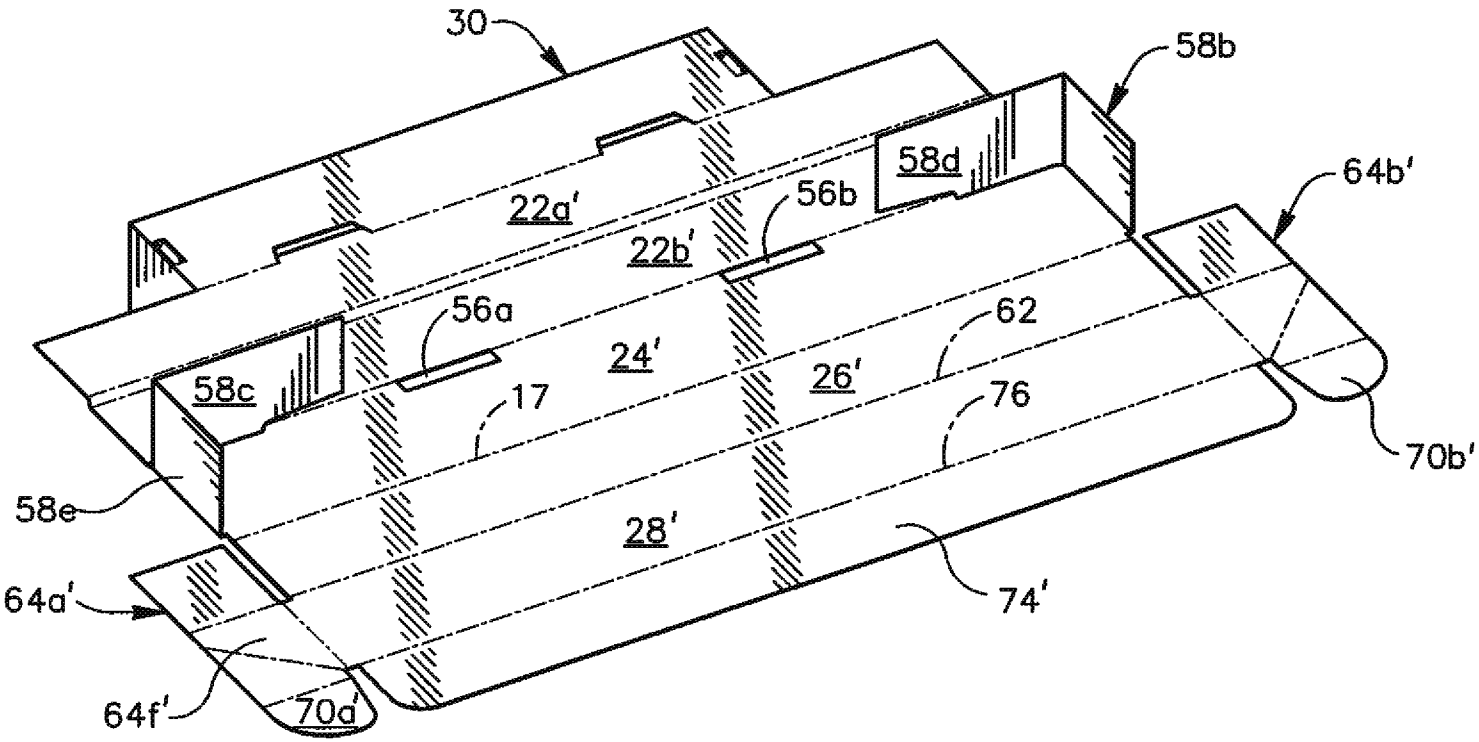
Figure 3C:
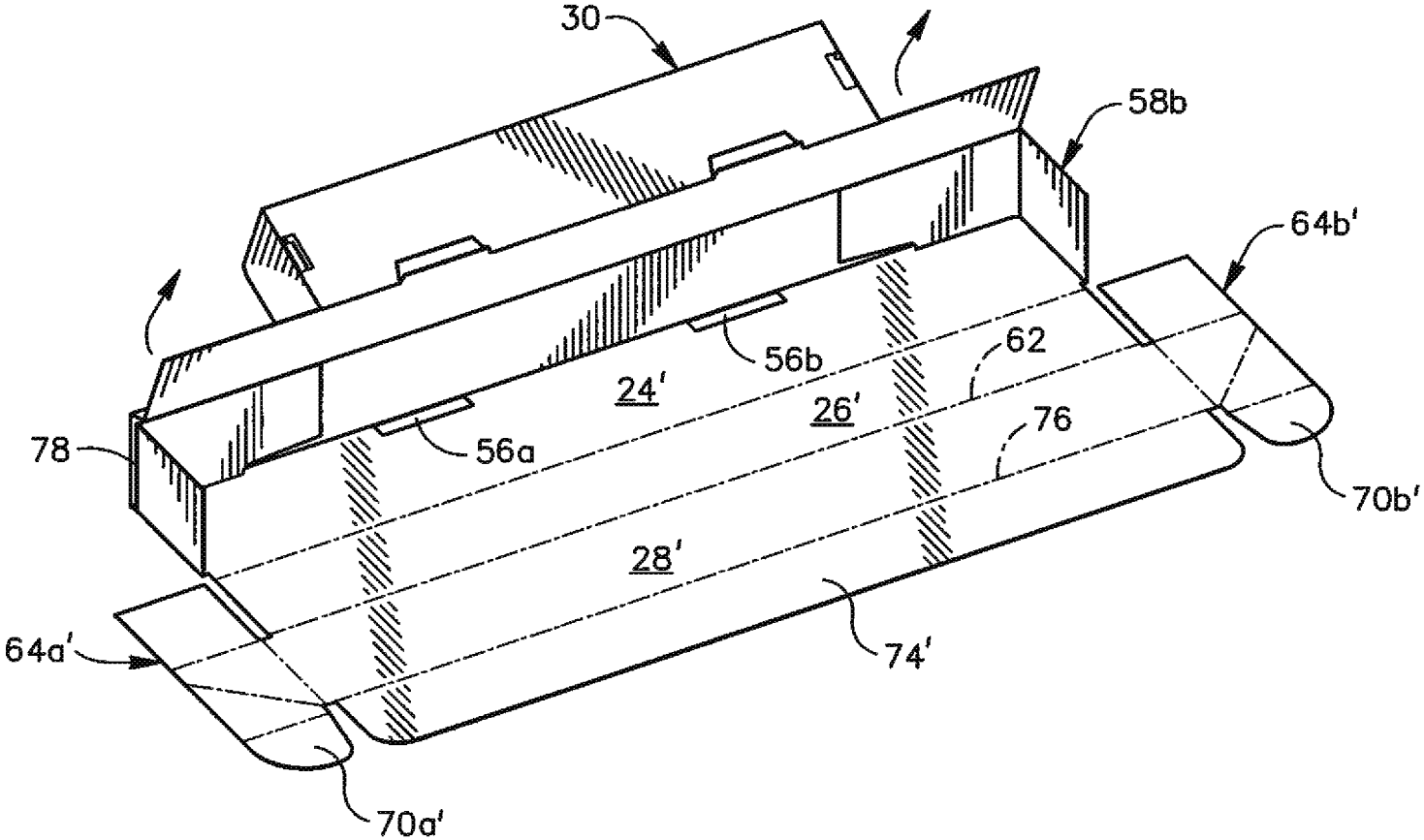
Figure 3D:
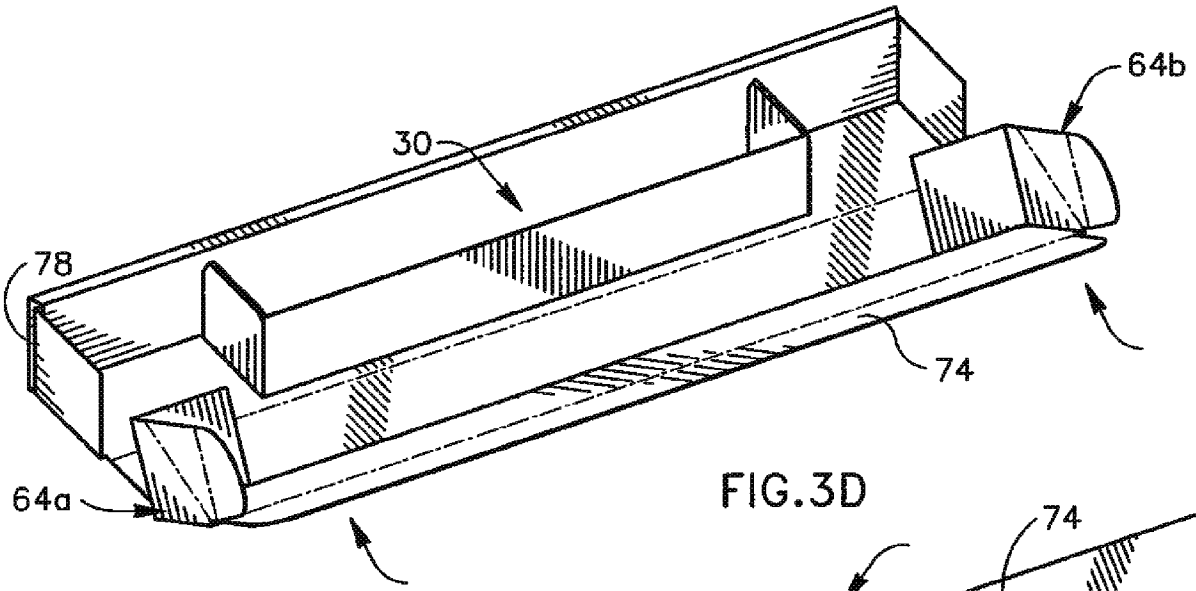
Figure 3E:
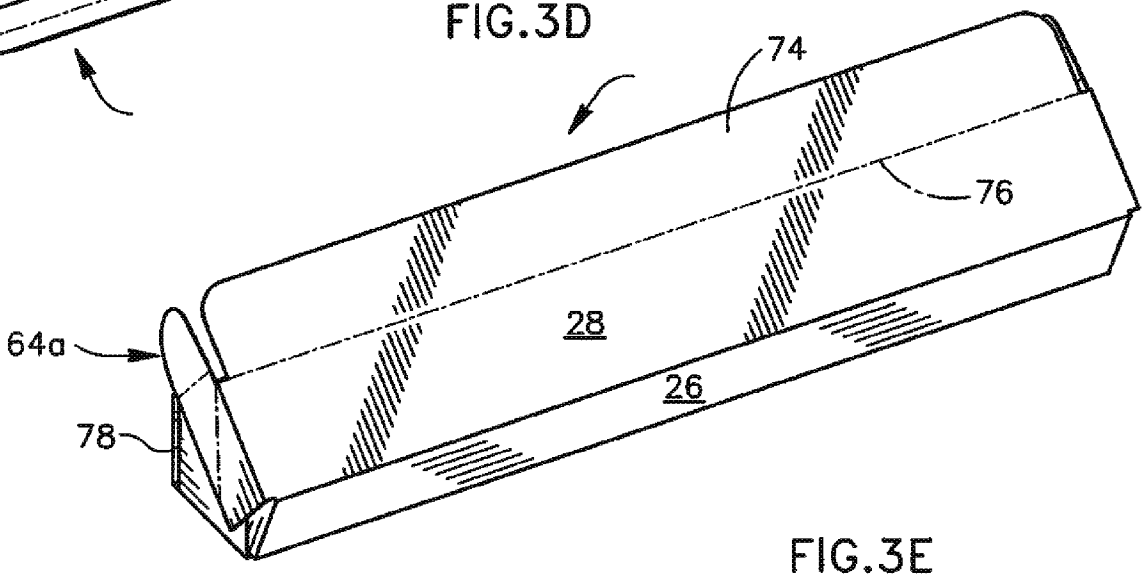
Figure 4:
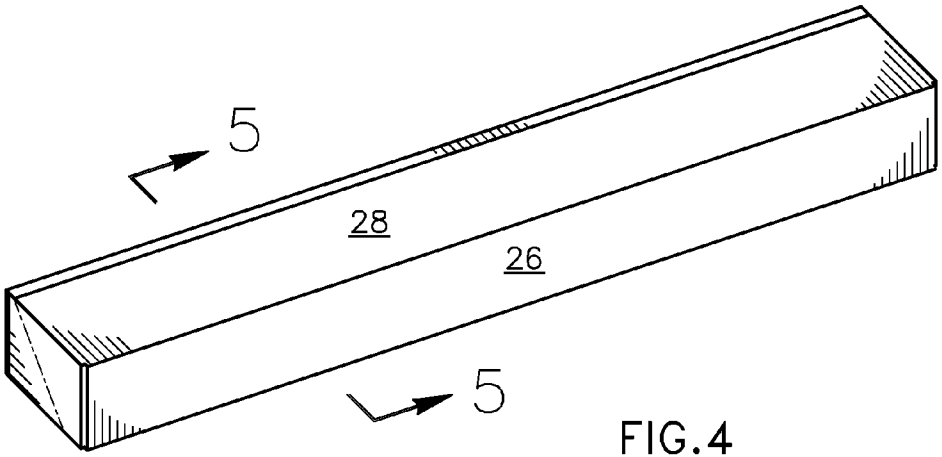
FIG. 4 is a top perspective view of the constructed pallet runner for use in the collapsible bulk bin container.
Figure 5:
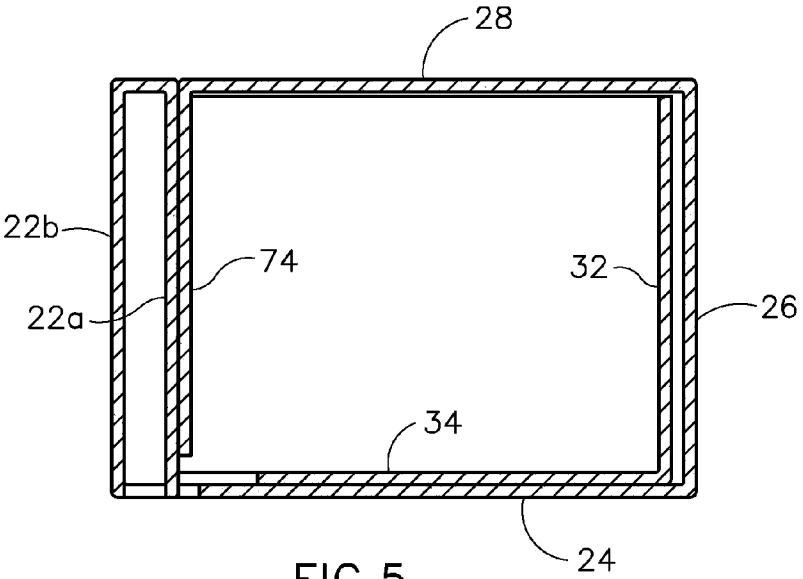
FIG. 5 is a cross sectional view of the pallet runner taken along line 5-5 of FIG. 4.

Referring to FIGS. 3A-3E, manual set-up of the pallet runner 18 is easily accomplished. However, an ordinary skilled in the art would appreciate that a folding machine may alternatively perform the forming operations. In addition, depending on the size of the collapsible bulk bin container 10, any number of pallet runners 18 can be used, but in the preferred embodiment of the present invention, three pallet runners 18 are used. The blank B1 is laid horizontally with inside face down and in the first step of folding sequence the inner support structure 20 is constructed by folding the first panel 32' up right with respect to panel 34' at the fold line 36 and simultaneously folding inwardly the first and second flaps 38*a*, 38*b*. Next, Respective third and fourth flaps 42*a*', 42*b*' and the respective fifth and sixth flaps 44*a*, 44*b* are folded onto one another in overlapping relationship with the first and second flaps 38*a*, 38*b* such that the first and second flaps 38*a*, 38*b* are tucked in between third and fourth flaps 42*a*', 42*b*' and the respective fifth and sixth flaps 44*a*, 44*b* and then the first and second locking tabs 48*a*, 48*b* are inserted to the corresponding first and second slots 46*a*, 46*b*. The blank B1 is now flipped over and the first and second front roll minor flaps 58*a*, 58*b* are folded as depicted in FIG. 3B. Next, the first double side wall panels 22*a*', 22*b*' are folded as depicted in FIGS. 3C and 3D in a manner that the first long flaps 58*c*', 58*d*' are disposed between the first double side wall panels 22*a*', 22*b*' and finally the inner support structure 20 folds over and the respective third and fourth tabs 50*a*, 50*b* are inserted to the respective third and fourth slots 56*a*, 56*b*. Next, the side wall 26', the top wall 28', and the respective first and second rear rolls minor flaps 64*a*, 64*b* are folded as illustrated in FIGS. 3D and 3E. Finally, the locking tabs 70*a*, 70*b* are inserted into gap 78 that is formed by the first double side wall panels 22*a*', 22*b*' to form the pallet runner 18. The locking tabs 70*a*, 70*b* completely enclose the respective opposed ends of the pallet runner 18. The cross section structure of pallet runner 18 as illustrated in FIG. 5 provide significant support for the plurality of articles contained in the collapsible bulk bin container 10.

Figure 6:
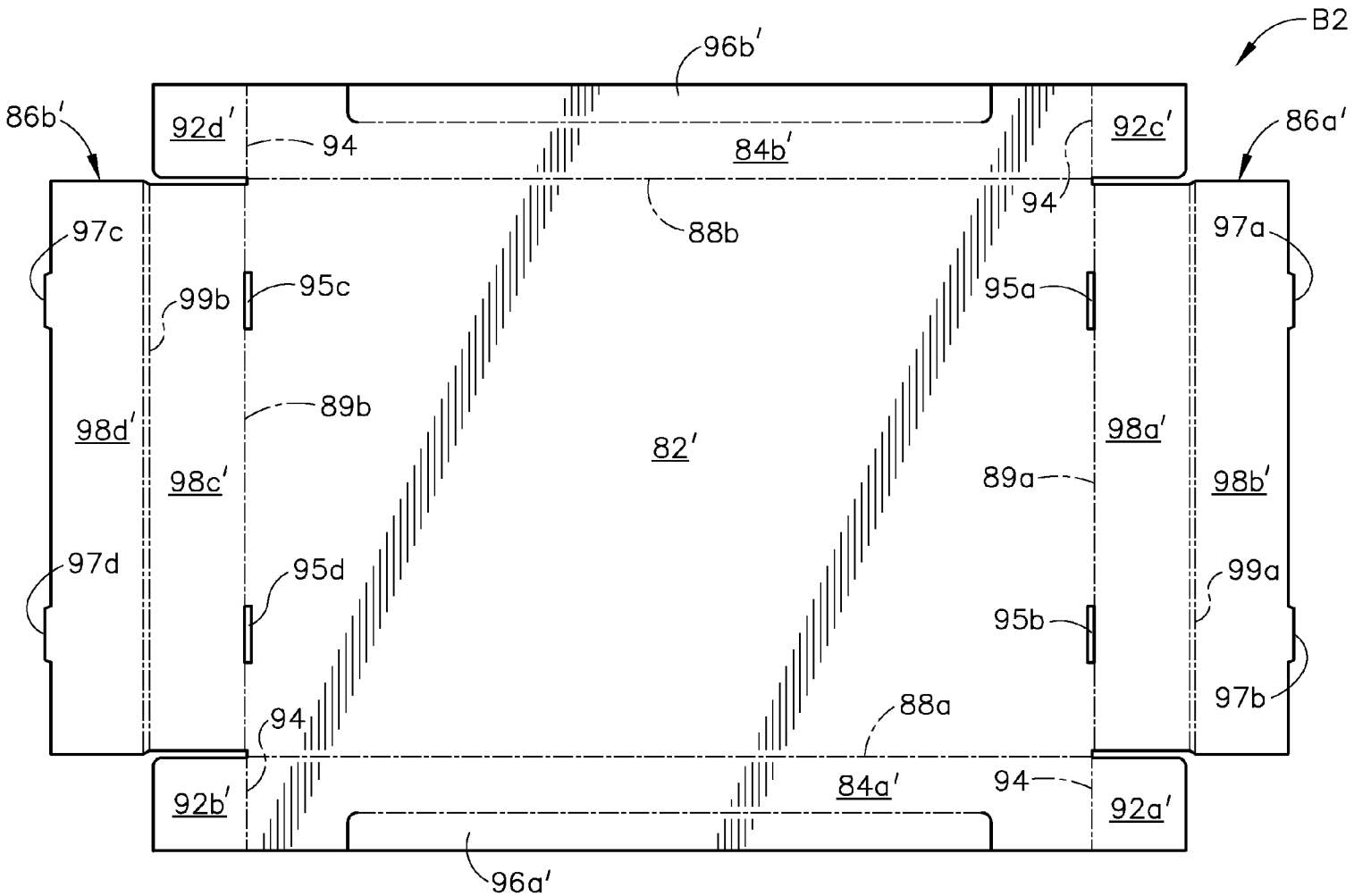
FIG. 6 is a top plan view of a blank B2 for making the lid for the collapsible bulk bin container in accordance to a preferred embodiment of the present invention.

FIG. 6 is a top plan view of a blank B2 for making the lid 16 for the collapsible bulk bin container 10 in accordance to a preferred embodiment of the present invention. The blank B2 is preferably formed from a foldable corrugated paperboard, or the like, having generally planar and rectangular dimensions when in an unfolded, flat orientation. The blank B2 is divided by fold lines or score lines to define panels which are foldable relative to one another (as described in greater detail below) to form the lid portion 16 of the collapsible bulk bin container 10. The blank B2 is divided into a top wall panel 82', first and second side wall panels 84*a*', 84*b*' and first and second end wall panels 86*a*', 86*b*' by a pair of longitudinal fold lines 88*a*, 88*b* and a pair of transverse fold lines 89*a*, 89*b* as shown in phantom lines. Each of the side wall panels 84*a*', 84*b*' includes a respective pair of lid flaps 92*a*', 92*b*', 92*c*', 92*d*' foldably extend from lateral edges and are defined by respective fold line 94. Furthermore, each of side wall panels 84*a*', 84*b*' also includes fork access panel 96*a*', 96*b*' which allows fork access when in the collapsed position. Each of the first and second end wall panels 86*a*', 86*b*' defines by a respective pair of end flaps 98*a*', 98*b*' and 98*c*', 98*d*' that folds over onto one another. For example, the end flap 98*b*' folds over onto end flap 98*a*' at the fold line 99*a* and the end flap 98*d*' folds over onto end flap 98*c*' at the fold line 99*b*. Each of the end flap 98*b*' and 98*d*' includes a pair of end wall tabs 97*a*, 97*b* and 97*c*, 97*d* at its respective free edges which are spaced apart from one another and are inserted into respective slots 95*a*, 95*b* and 95*c*, 95*d* when the blank B2 is fully constructed for making the lid 16.

Figure 7A:
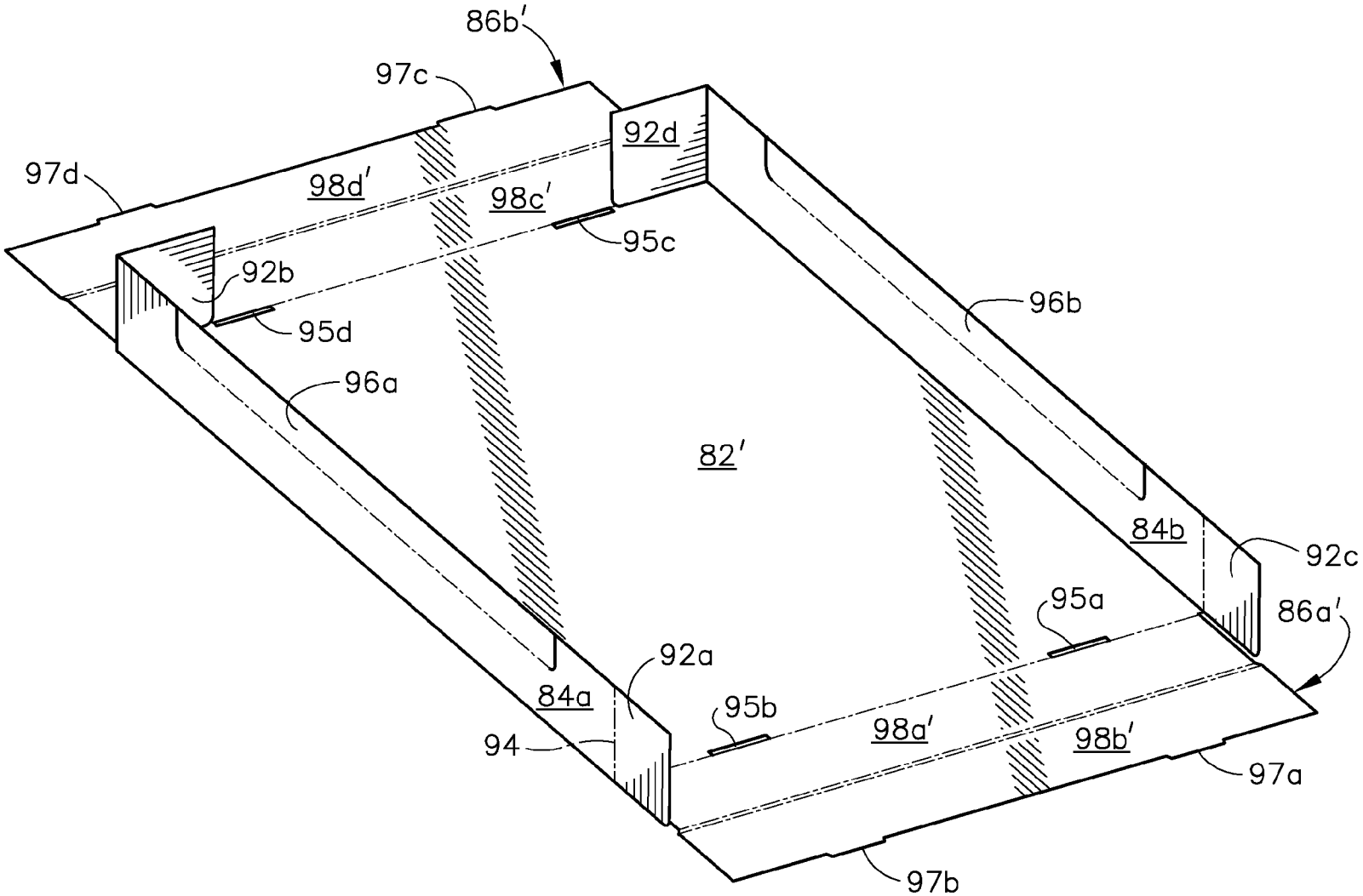
FIGS. 7A-7B illustrates the folding sequences of the blank B2 shown in FIG. 6 for constructing the lid in accordance to the present invention.
Figure 7B:
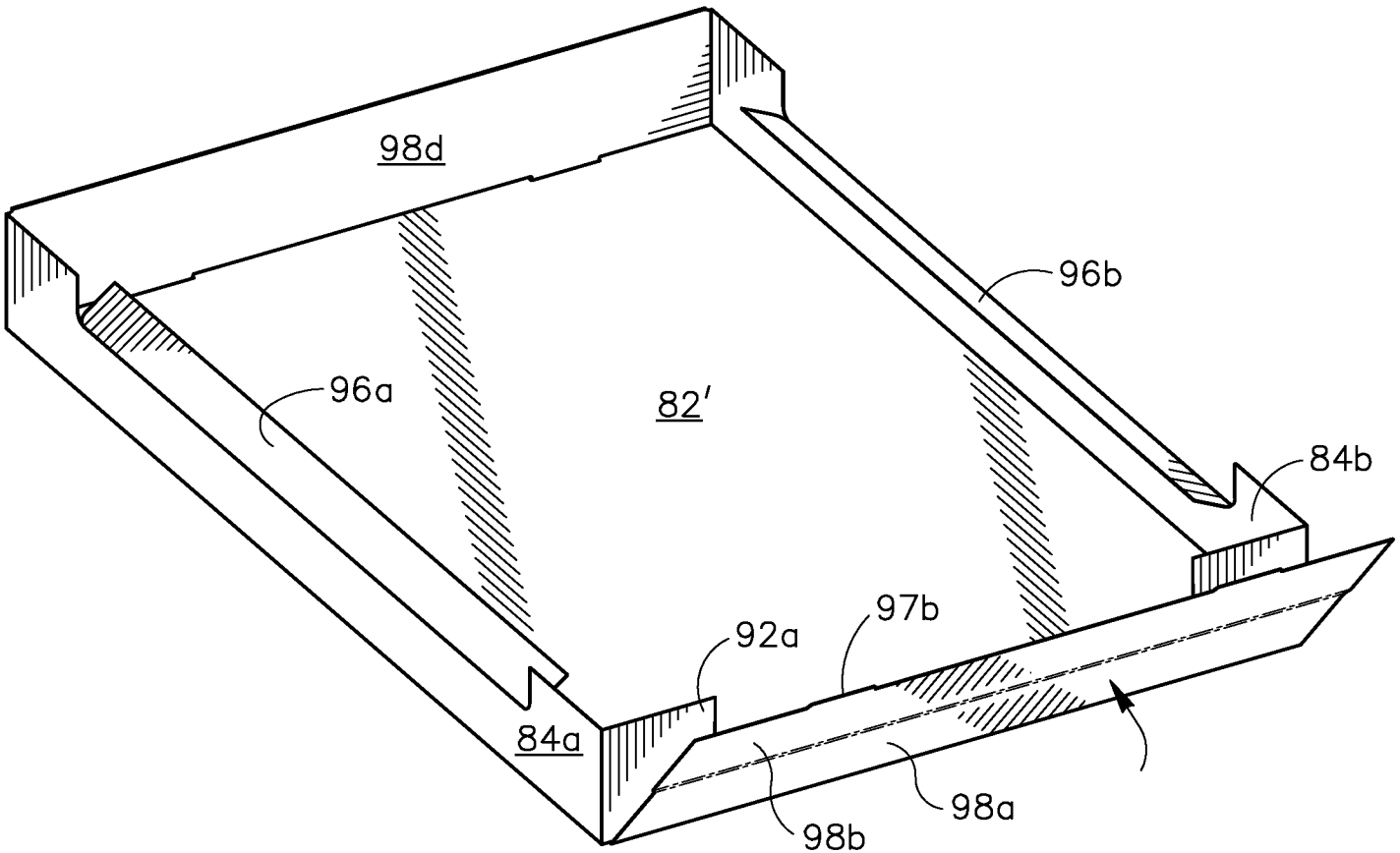
Figure 8:
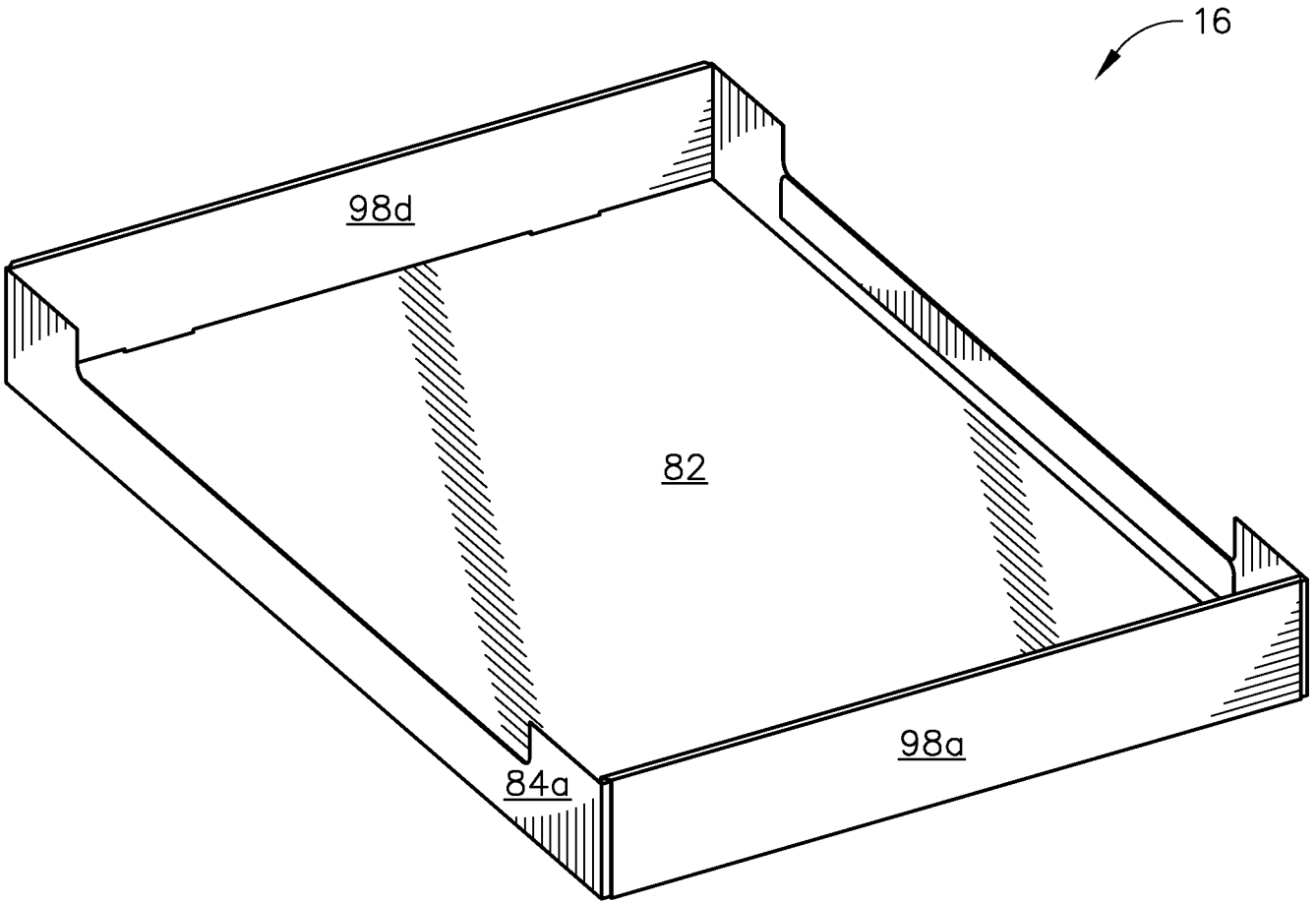
FIG. 8 is a top perspective view of the constructed lid for use in the collapsible bulk bin container.

FIGS. 7A-7B illustrates the folding sequences of the blank B2 shown in FIG. 6 for constructing the lid 16 in accordance to the present invention. Although manual set-up of the lid 16 is easily accomplished, but an ordinary skilled in the art would appreciate that a folding machine may alternatively perform the forming operations. The blank B2 is laid horizontally and each of the side wall panels 84*a*', 84*b*' are folded upwardly to form a right angle with respect to the top wall panel 82' and the a respective pair of lid flaps 92*a*', 92*b*', 92*c*', 92*d*' are folded toward one another to form a right angle with the respective side wall panels 84*a*', 84*b*'. Next, each of the end flap 98*b*', 98*d*' is folded onto their respective end flaps 98*a*', 98*c*' along their respective fold lines 99*a*, 99*b* and the respective end wall tabs 97*a*, 97*b* and 97*c*, 97*d* are inserted into respective slots 95*a*, 95*b* and 95*c*, 95*d*. Finally, the fork access panel 96*a*', 96*b*' are folded as depicted in FIG. 7B to illustrate the top perspective view of the constructed lid 16 in FIG. 8 for use in the collapsible bulk bin container.

Figure 9:
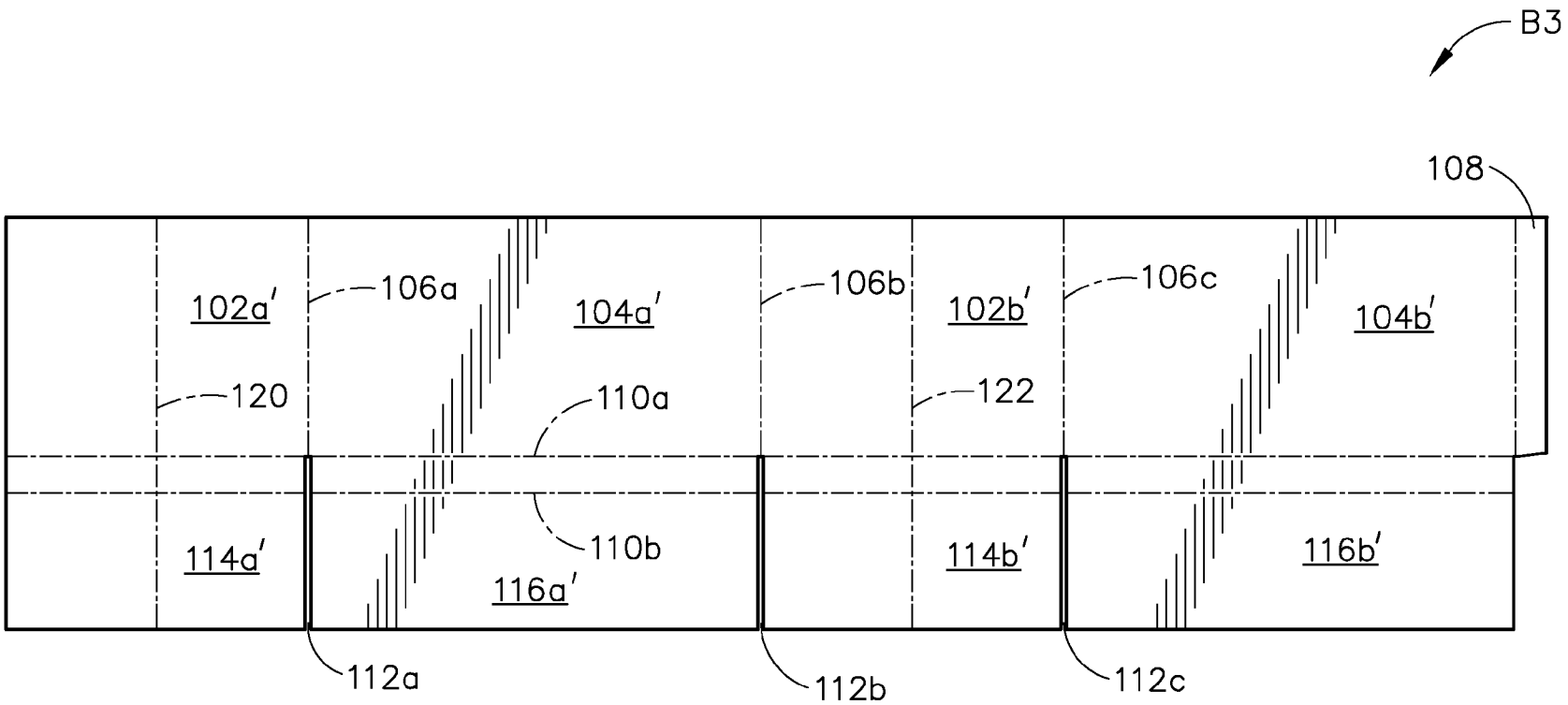
FIG. 9 is a top plan view of a blank B3 for making a foldable sidewall body blank for use in the collapsible bulk bin container.

FIG. 9 is a top plan view of a blank B3 for making a foldable sidewall body 14 for use in the collapsible bulk bin container. The foldable sidewall body 14 is constructed from the blank B3 having preferably two end wall panels 102*a*, 102*b* and two side wall panels 104*a*, 104*b* defined by fold lines 106*a*, 106*b*, and 106*c*. A glue flap 108 is used to connect opposed ends of the blank B3 to one another in an end-to-end relation. In addition, flap-forming fold lines 110*a*, 110*b* extend the length of the blank B3 and cooperates with flap-forming slits 112*a*, 112*b*, 112*c*, to define side wall body flaps 114*a*, 114*b*, 116*a*, 116*b*, which cooperate with one another to define a closed bottom end 118 in a manner known generally to those of ordinary skilled in the art. Articulation folds 120, 122 are formed within the end wall panels 102*a*, 102*b* to facilitate both constructing the end wall panels 102*a*, 102*b* from the collapsed position and the collapse or folding of the end wall panels 102*a*, 102*b* from constructed position. Respective articulation folds 120, 122 bisect respective end wall panels 102*a*, 102*b*.

Figure 10A:
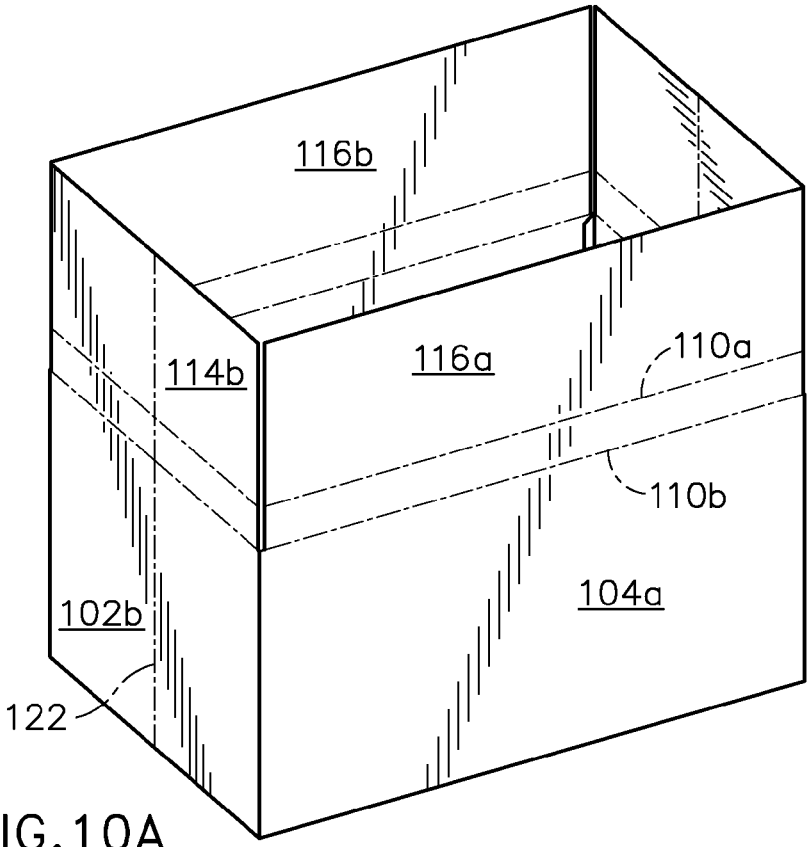
FIGS. 10A-10E illustrates the folding sequences of the blank B3 shown in FIG. 9 for constructing the foldable sidewall body in accordance to the present invention.
Figure 10B:
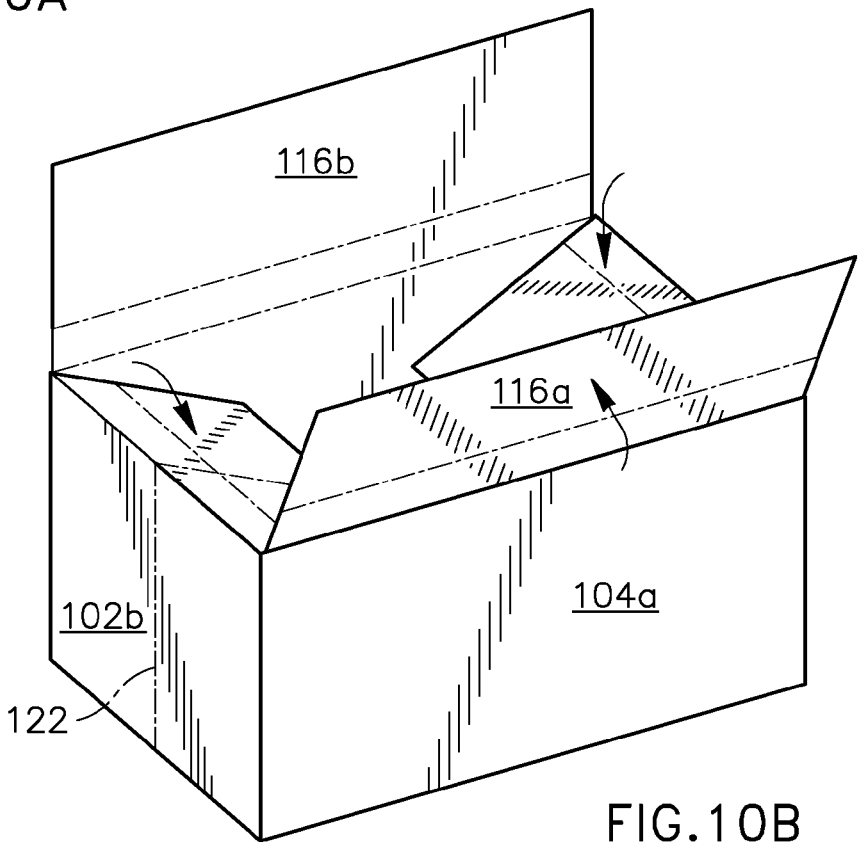
Figure 10C:
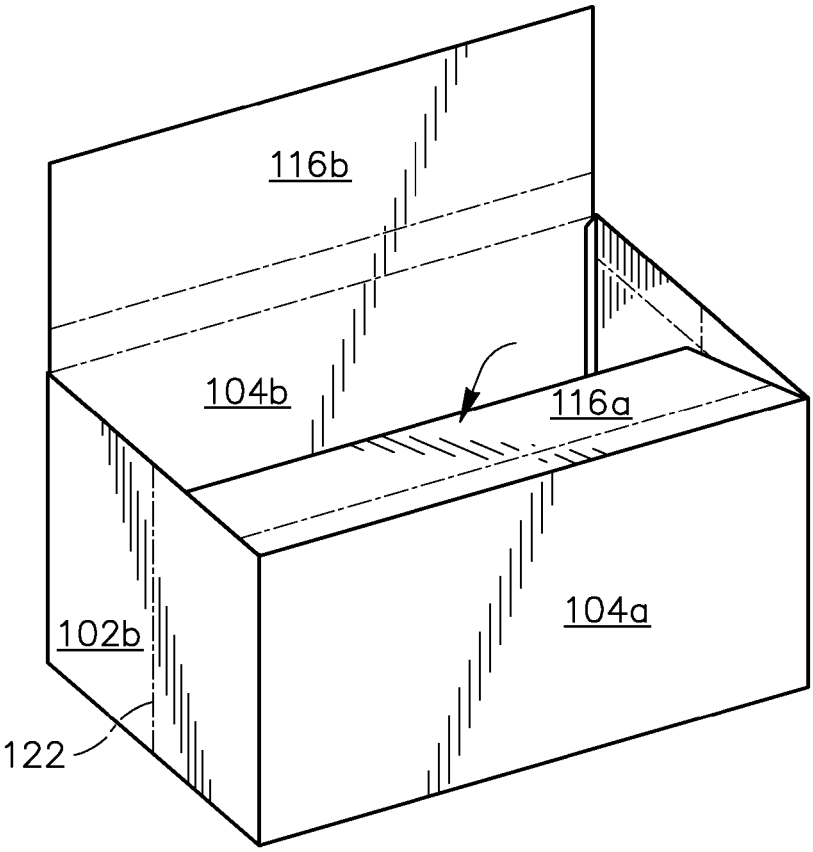
Figure 10D:
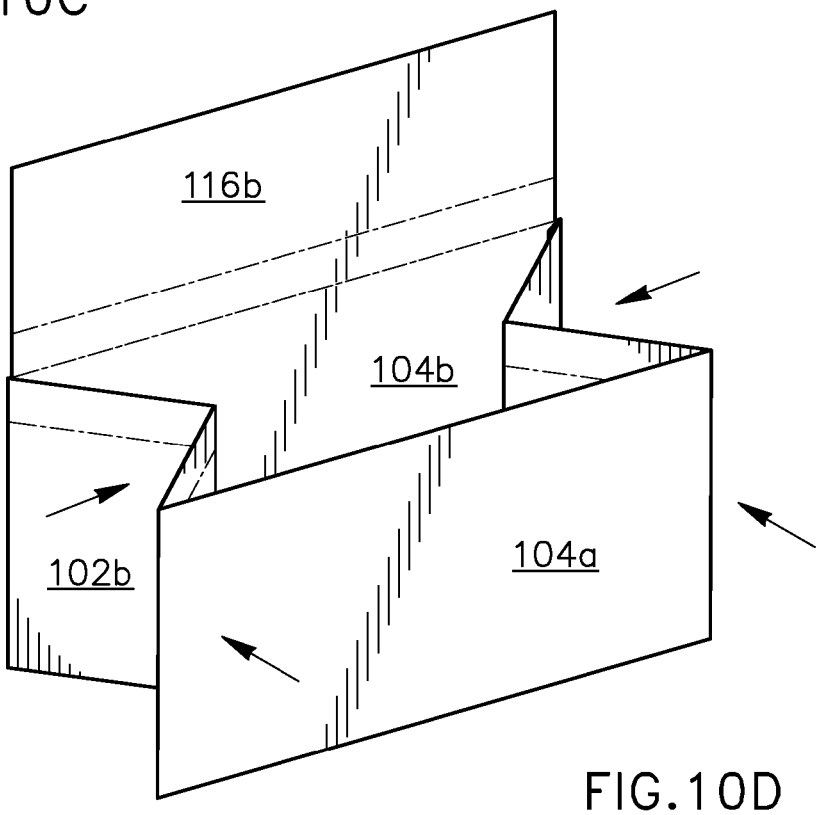
Figure 10E:
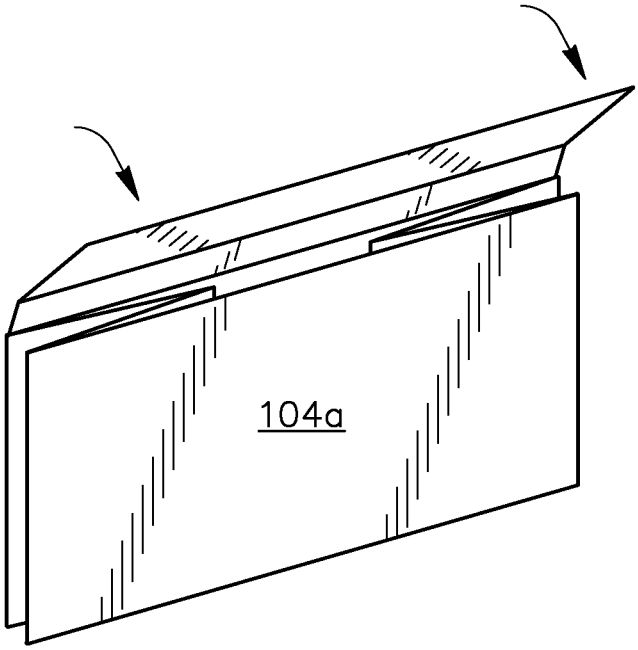
Figure 11:
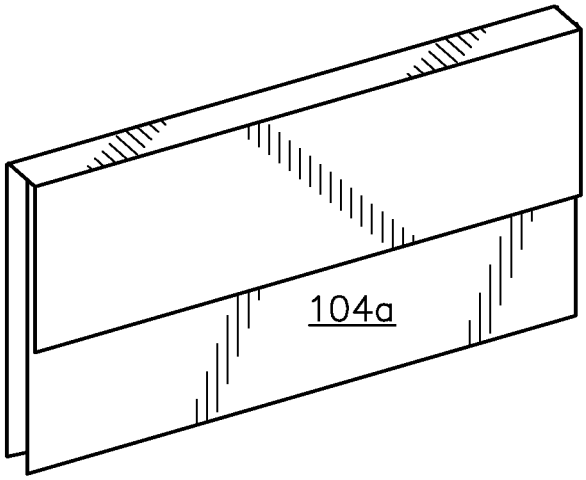
FIG. 11 is a top perspective view of the constructed foldable sidewall body for use in the collapsible bulk bin container.

FIG. 10A-10E illustrates the folding sequences of the blank B3 shown in FIG. 9 for constructing the foldable sidewall body 14. Although manual set-up of the foldable sidewall body 14 is easily accomplished, but an ordinary skilled in the art would appreciate that a folding machine may alternatively perform the forming operations. The blank B3 is folded at the respective fold lines 106*a*, 106*b*, 106*c* and then the glue flap 108 is adhesively, but not limited to, attached to the edge of the end wall panel 102*a* as shown in FIG. 10A. Next, the end wall flaps 114*a*, 114*b* are folded inwardly toward the interior of the sidewall body 14 and similarly, the side wall body flap 116*a* is folded inwardly toward the interior of the sidewall body 14 as shown in FIGS. 10B, 10C. The side wall body flap 116*b* is designated as attachment flap 116*b*. Next, respective end wall panels 102*a*, 102*b* are pushed inwardly toward one another in a manner that the articulation folds 120, 122 move toward the interior of the sidewall body 14 to, in turn, facilitate the collapse of the end wall panels 102*a*, 102*b* as illustrated in FIGS. 10D, 10E. Finally, the attachment flap 116*b* is fold over the side wall panel 104*a* in an overlapping relationship. When the folding sequence is completed, the foldable sidewall body 14 resembles a briefcase as depicted in FIG. 11.

Figure 12:
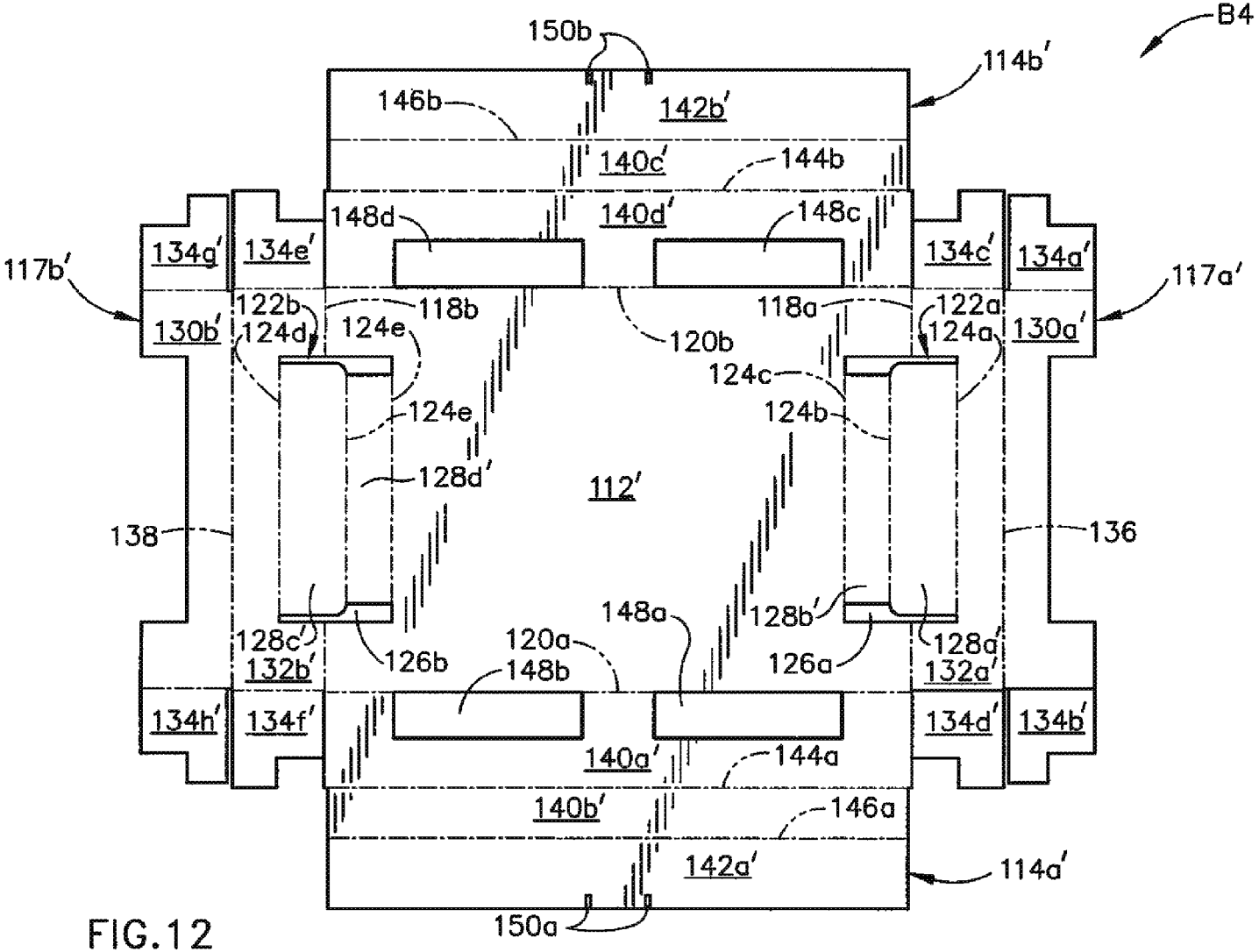
FIG. 12 is a top plan view of a blank B4 for making a foldable tray for the collapsible bulk bin container in accordance to a preferred embodiment of the present invention.
Figure 13A:
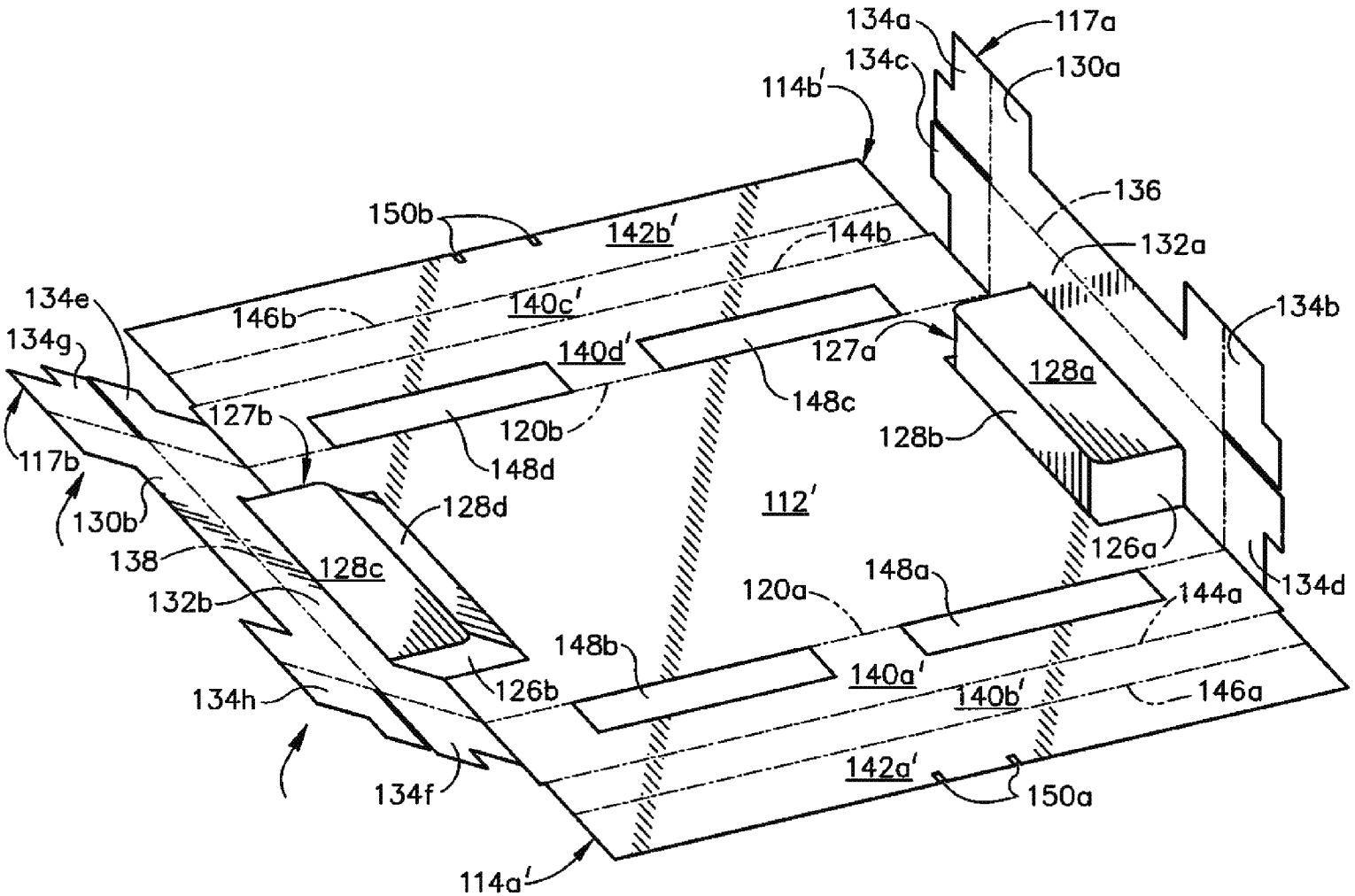
FIGS. 13A-13D illustrates the folding sequences of the blank B4 shown in FIG. 12 for constructing the foldable tray in accordance to the present invention.

FIG. 12 is a top plan view of a blank B4 for making a foldable tray 12 for the collapsible bulk bin container 10 in accordance to a preferred embodiment of the present invention. The blank B4 is substantially flat symmetrical with respect to its lateral axis and preferably is an integral piece of a material such as continuous sheet of conventional corrugated cardboard. The blank B4 is cut along its outer margins to form its specific shape. The foldable tray blank B4 comprises a base wall panel 112', two side wall panels 114*a*', 114*b*', and two end wall panels 117*a*', 117*b*' which are formed by two pairs of respective fold lines 118*a*, 118*b*, and 120*a*, 120*b* intersecting one another at right angles. Two pallet runner sleeves 122*a* and 122*b* are formed between the base wall panel 112' and the two opposed end wall panels 117*a*', 117*b*'. Each of the pallet runner sleeves 122*a*, 122*b* defined by respective three cut lines 124*a*, 124*b*, 124*c* and 124*d*, 124*e*, 124*f* and respective cutting away 126*a*, 126*b* of the base wall panel 112' and two end wall panels 117*a*', 117*b*'. Each of the pallet runner sleeves 122*a*, 122*b* has two surfaces 128*a*, 128*b* that are formed by their respective three cut lines 124*a*, 124*b*, 124*c* and 124*d*, 124*e*, 124*f*. Each of the respective pallet runner sleeves 122*a*, 122*b* resembles an elongated rectangular tube with two opposed open ended 127*a*, 127*b* when the foldable tray 110 is fully constructed as depicted in FIG. 13A. Each of the end wall panels 117*a*', 117*b*' includes respective inner and outer end panel 130*a*, 132*b* and 130*b*, 132*b* each of which having a respective pair of minor end flaps 134*a*, 134*b*; 134*c*, 134*d*; 134*e*, 134*f*; 134*g*, and 134*h*. The inner and outer end panel 130*a*, 132*b* and 130*b*, 132*b* are mirror image of one another and fold onto one another along respective fold lines 136 and 138 in an overlapping relationship.

Each of the side wall panels 113*a*', 113*b*' includes respective inner and outer panels 140*a*, 140*b* and 140*c*, 140*d* and respective shoulder panel 142*a*, 142*b*. The inner and outer panels 140*a*, 140*b* are defined by fold line 144*a* and the shoulder panel 142*a* is defined by fold line 146*a*. Similarly, the inner and outer panels 140*c*, 140*d* are defined by fold line 144*b* and the shoulder panel 142*b* is defined by fold line 146*b*. Each of the two side wall panels 113*a*', 113*b*' includes a respective pair of fork access entry 148*a*, 148*b* and 148*c*, 148*d* formed on respective outer panel 140*a* and 140*d*. The fork access entry 148*a*, 148*b* are generally rectangular in shape and spaced apart from one another. Each of the side wall panels 113*a*', 113*b*' includes respective alignment marks 150*a*, 150*b* that are used to properly position and align when the pallet runner 18 is attached to the foldable tray 12.

Figure 13B:
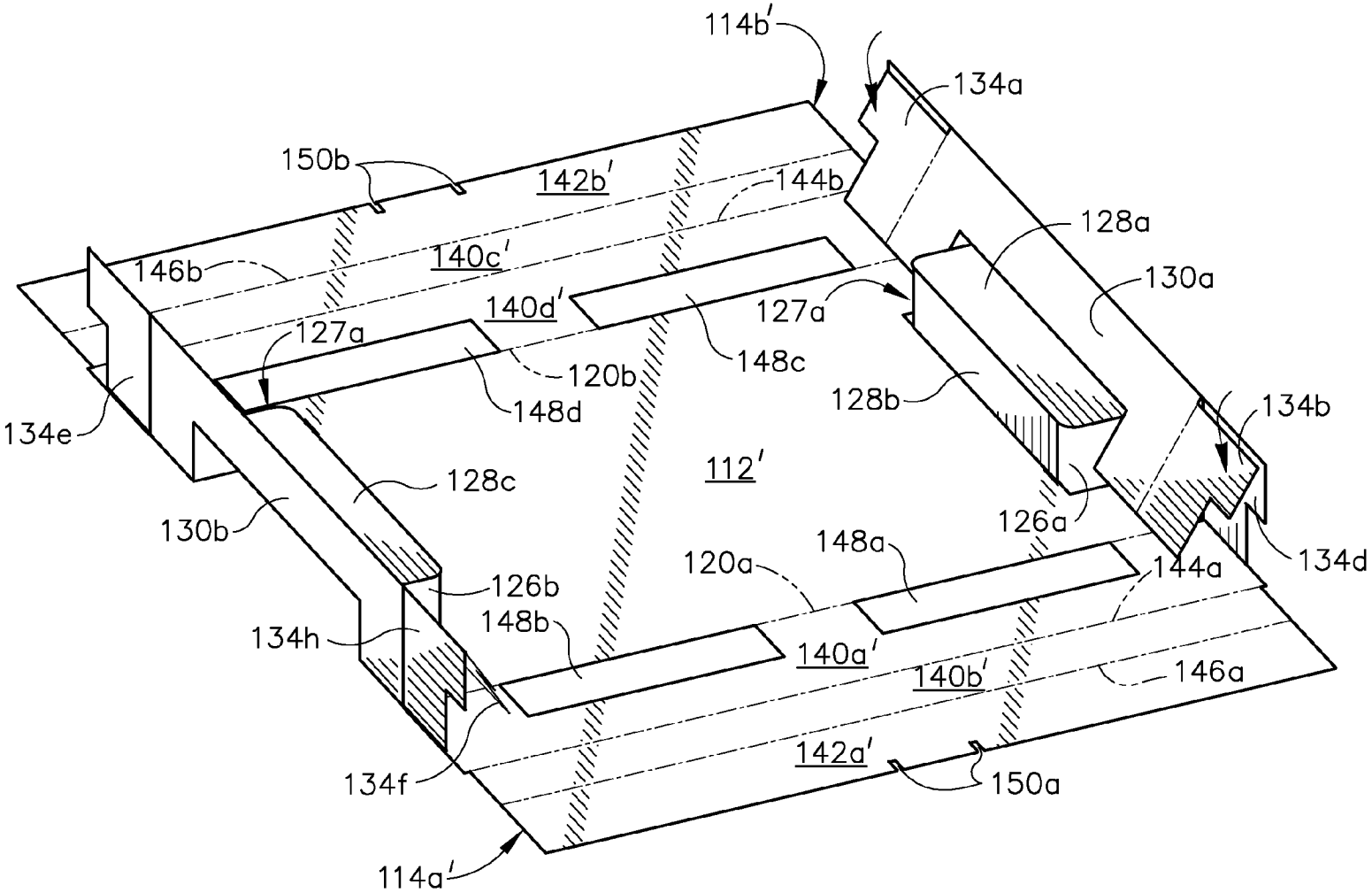
Figure 13C:
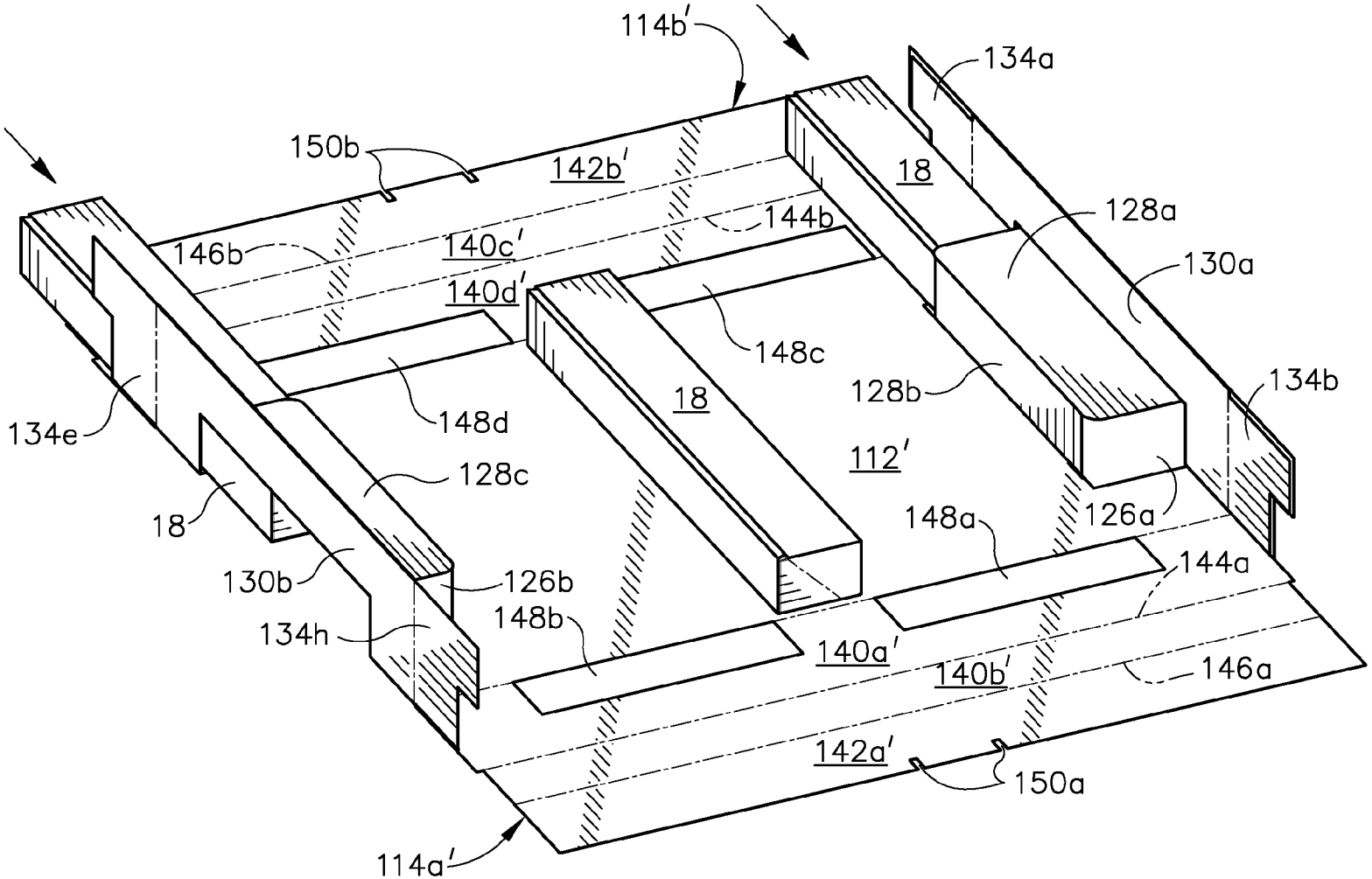
Figure 13D:
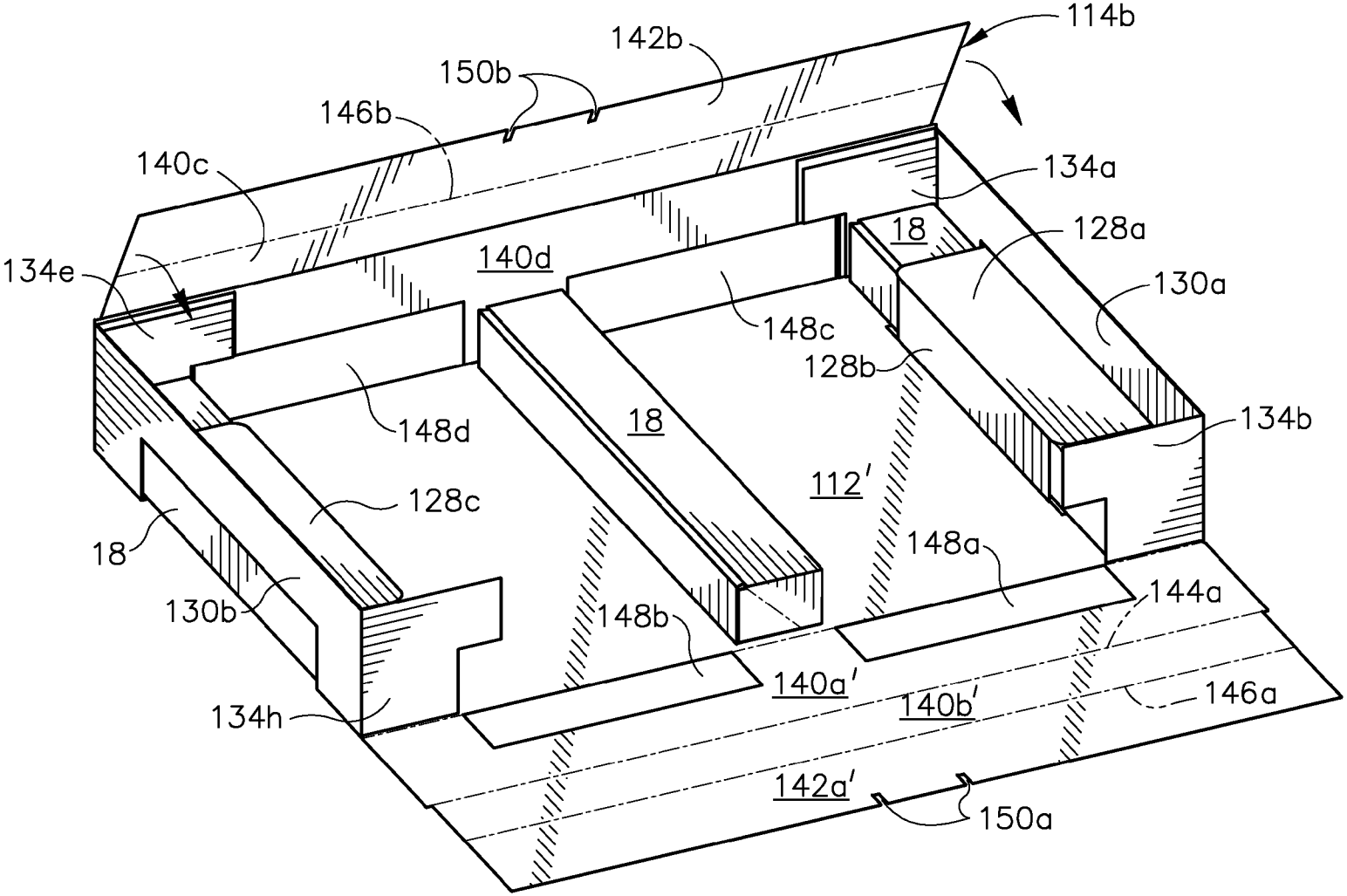
Figure 14:
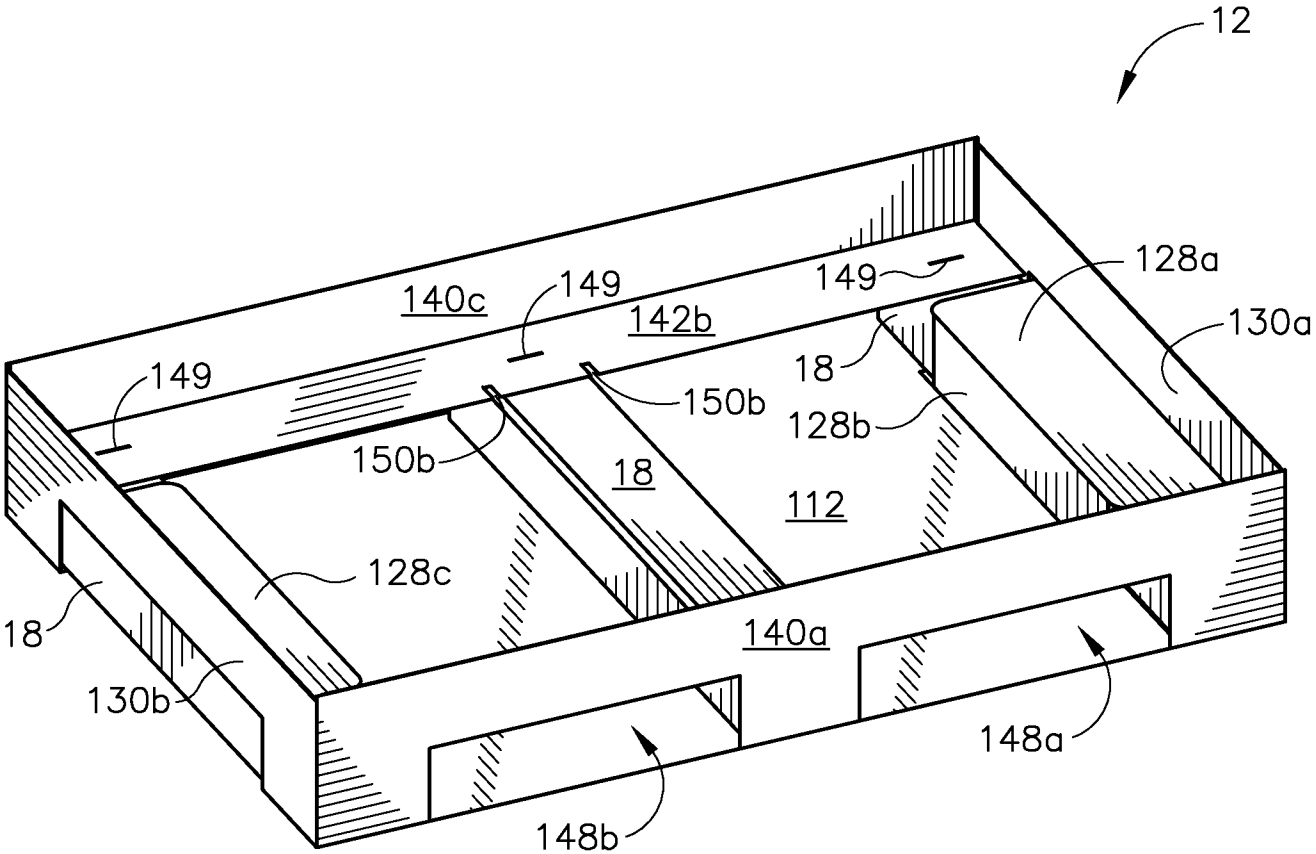
FIG. 14 is a top perspective view of the constructed foldable tray for use in the collapsible bulk bin container.

FIG. 13A-13D illustrates the folding sequences of the blank B4 shown in FIG. 12 for constructing the foldable tray 12 in accordance to the present invention. Although manual set-up of the foldable tray 12 is easily accomplished, but one of the ordinary skilled in the art would appreciate that a folding machine may alternatively perform the forming operations. In the first step of folding sequence, each of the end wall panels 117*a*', 117*b*' are folded upright along respective fold line 118*a*, 118*b* which, in turn, cause each of the pallet runner sleeves 122*a*, 122*b* to be unfolded so that the open ended 127*a*, 127*b* are formed, accordingly. Next, each of the respective inner end panel 130*a*, 130*b* is folded onto the respective outer end panel 132*a*, 132*b* in an overlapping relationship as depicted in FIG. 13B. Next, the pallet runners 18 are inserted into the respective openings 127*a*, 127*b* of the respective sleeves 122*a*, 122*b* as illustrated in FIG. 13C. Particularly referring to FIGS. 13C, 13D, one of the pallet runners 18 is disposed in the central portion of the base wall panel 112' and aligned with the alignment marks 150*a*, 150*b*. Next, each of the respective side wall panels 113*a*', 113*b*' fold upright so that respective inner and outer panels 140*a*, 140*b* folds onto one another and respective inner and outer panels 140*c*, 140*d* fold onto one another and the respective shoulder panels 142*a*, 142*b* are stapled 149 or otherwise affixed to the foldable tray 12 as depicted in FIG. 14.

Figure 15:
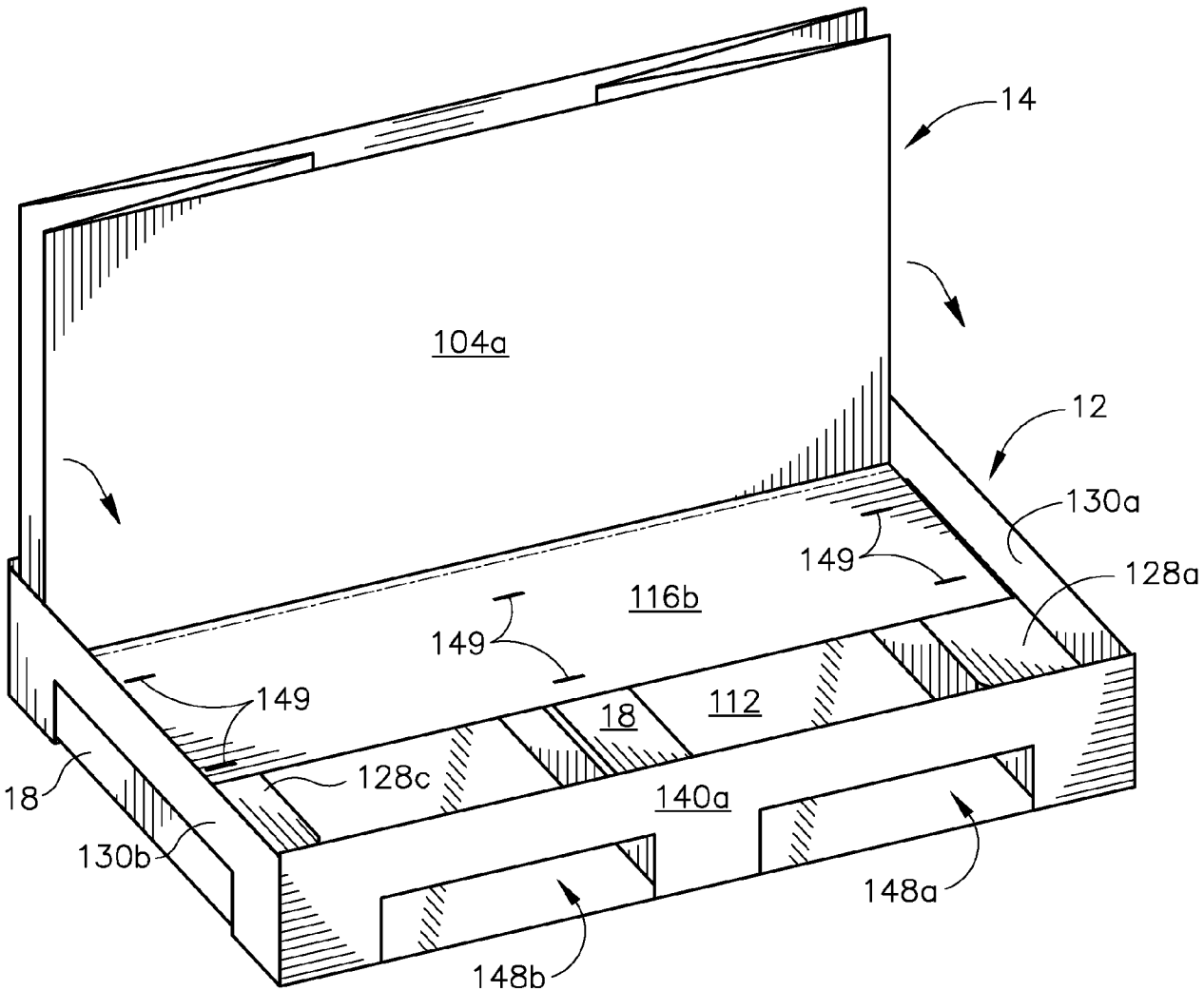
FIG. 15 illustrates the manner in which foldable sidewall body is attached to the foldable tray.

FIG. 15 illustrates the manner in which foldable sidewall body 14 is attached to the foldable tray 12. To do that, the side wall body attachment flap 116*b* is laid horizontally in a manner that is co-planner with respect to the foldable tray 12 and is stapled 149 or otherwise affixed to the foldable tray 12 in the locations as depicted in FIG. 15. Next, the two folded end wall panels 102*a*, 102*b* and the two folded side wall panels 104*a*, 104*b* of the sidewall body 14 are laid down in a position substantially co-planar with respect to the foldable tray 12.

Figure 16:
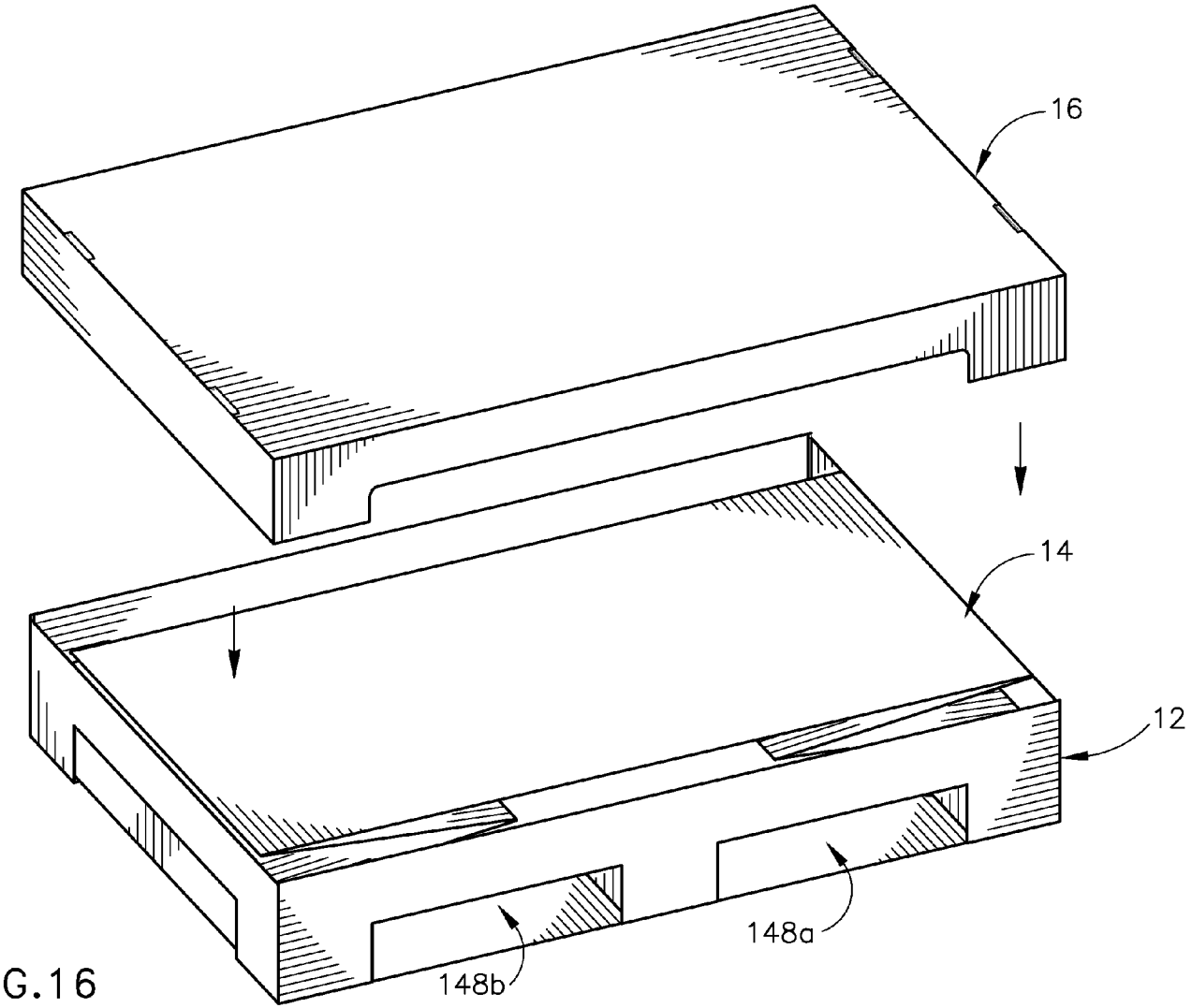
FIG. 16 is an exploded perspective view of the lid, foldable sidewall body, and foldable tray in accordance to a preferred embodiment of the present invention.
Figure 17:
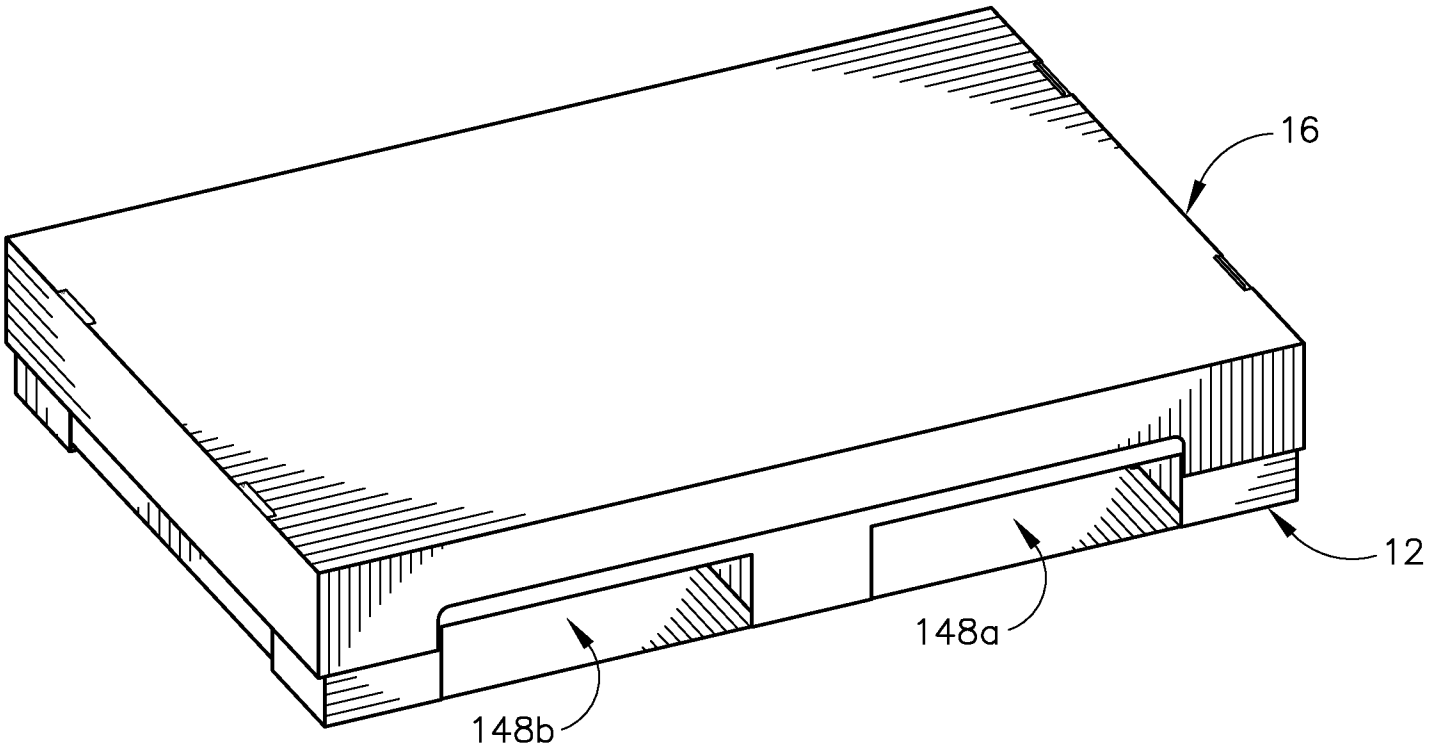
FIG. 17 is a top perspective view of the collapsible bulk bin container that can be shipped in a knocked-down flattened condition as a single contained unit.
Figure 18:
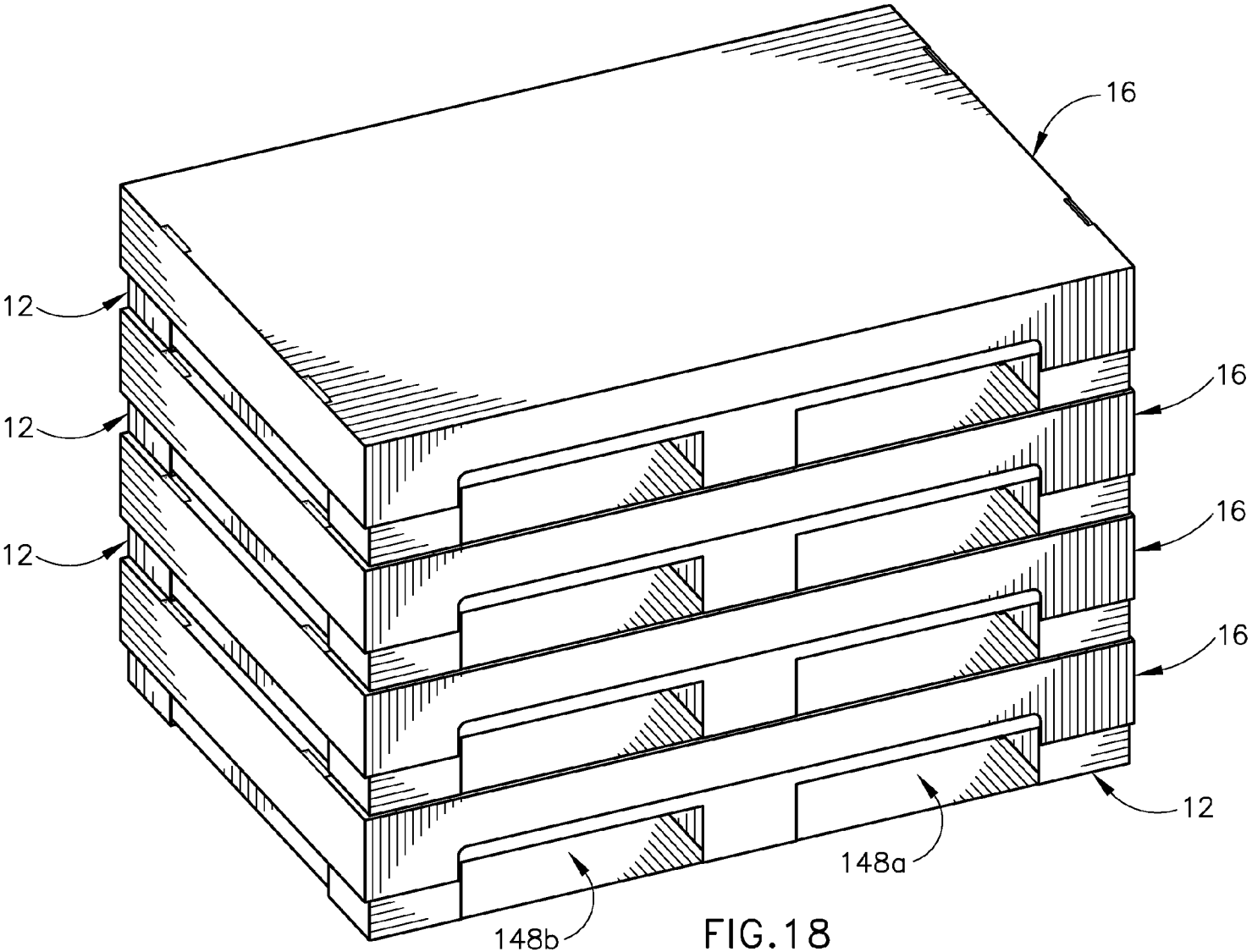
FIG. 18 is a top perspective view of a plurality of collapsible bulk bin containers stacked upon one another.

Illustrated in FIG. 16 is the foldable sidewall body 14 is fully collapsed inside foldable tray 12 with the lid 16 positioned in an exploded perspective view. It should be noted that the foldable sidewall body 14 sits inside the peripheral boundaries of the foldable tray having a minimum profile. The lid 16 is positioned over the foldable tray 12 so as to completely enclose the collapsed bulk bin container 10 for storage and transportation to an end user as depicted in FIG. 17. The lid 16 is also used to cap the collapsible bulk bin container 10 when in its fully constructed position of FIG. 21 so as to be capable of protecting the articles container in the collapsible bulk bin container 10. The fork access entry 148*a*, 148*b* are provided to accommodate the tines of a forklift during transportation of the collapsible bulk bin container 10. To significantly reduce the space and cost in transporting the collapsed bulk bin container 10, the containers may be stacked on one another as shown in FIG. 18.

Figure 19:
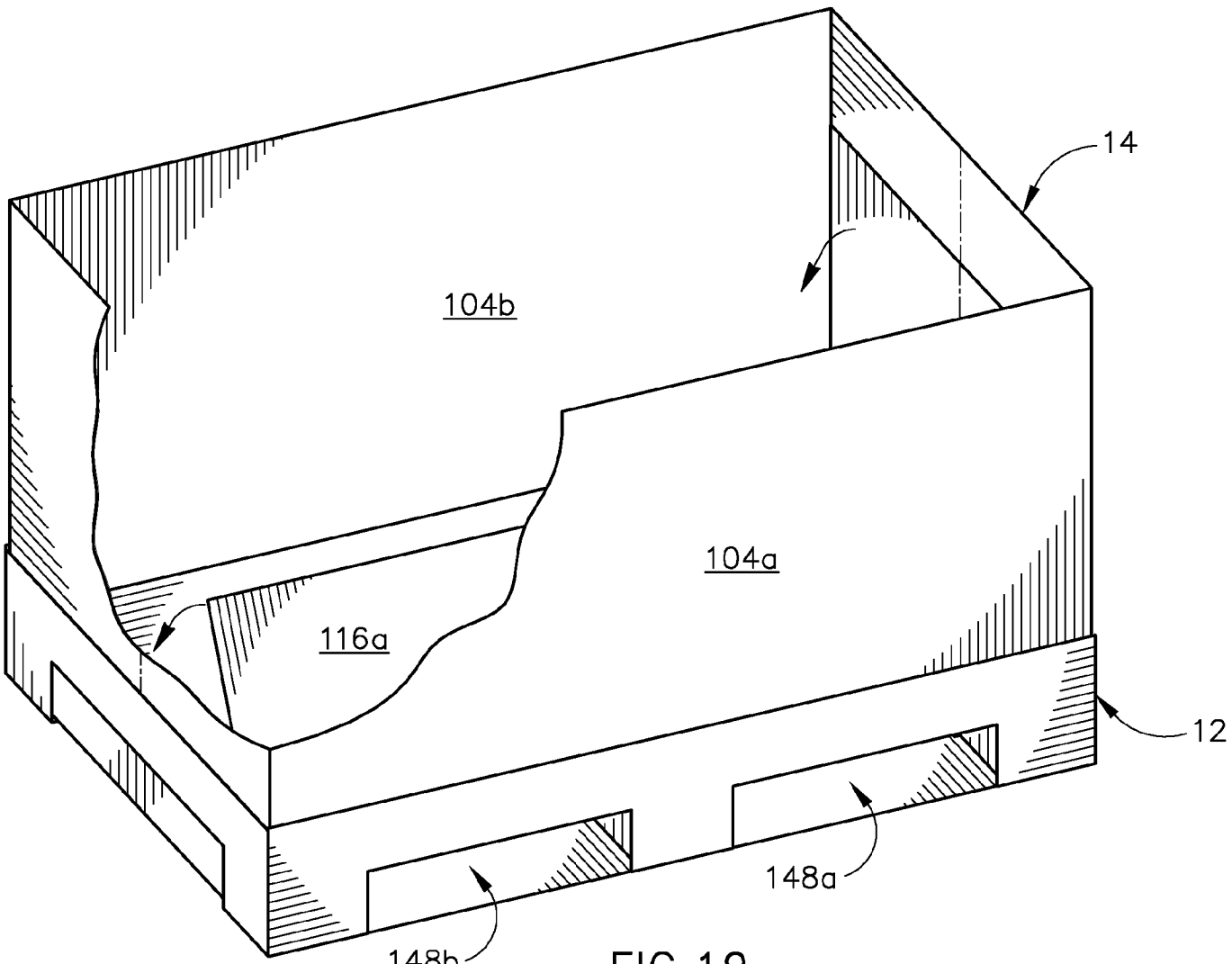
FIG. 19 is a top perspective view of a partially unfolded collapsible bulk bin container with the lid removed therefrom.
Figure 20:
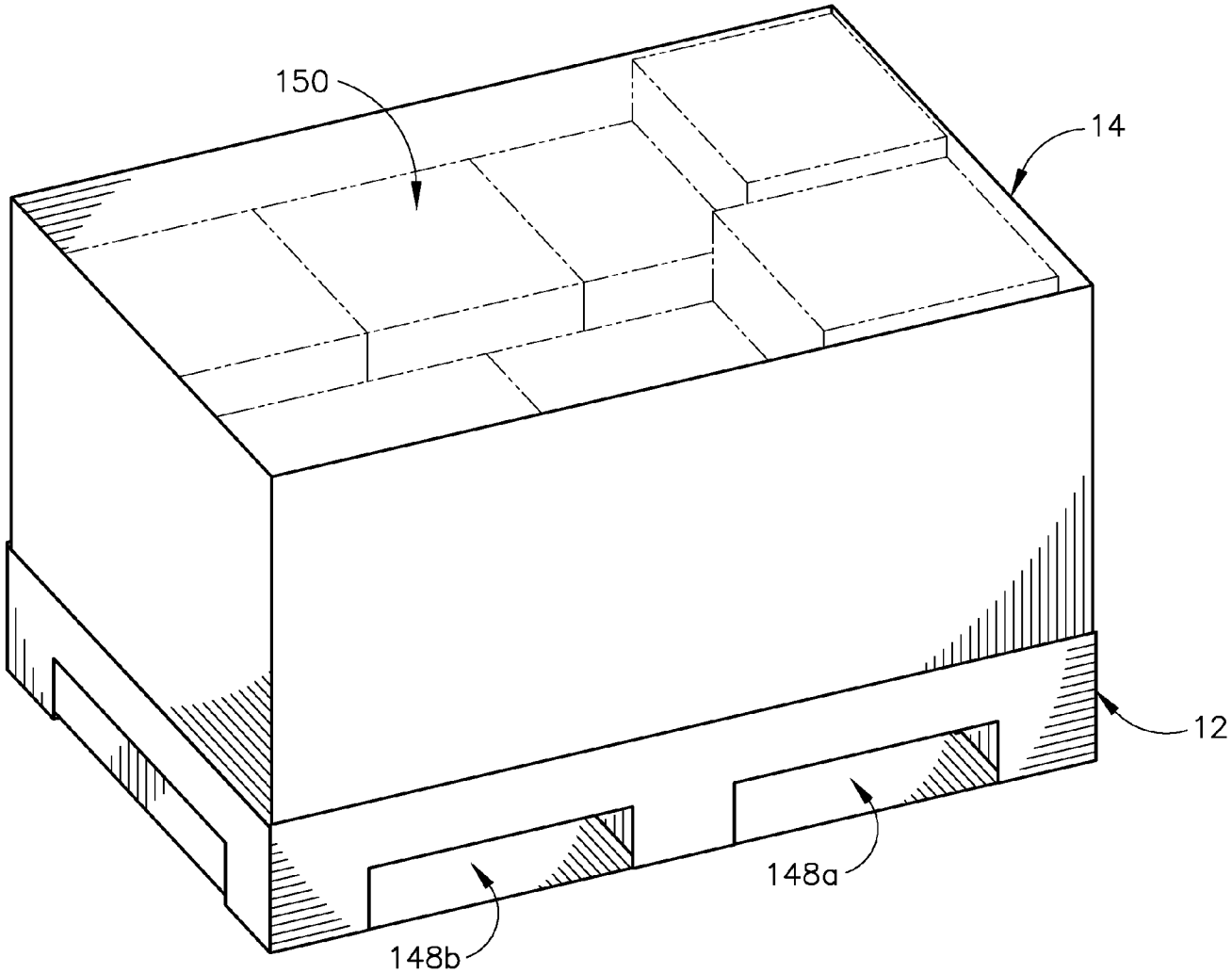
FIG. 20 is a top perspective view of the collapsible bulk bin container shown in FIG. 19 with partially filled up articles.
Figure 21:
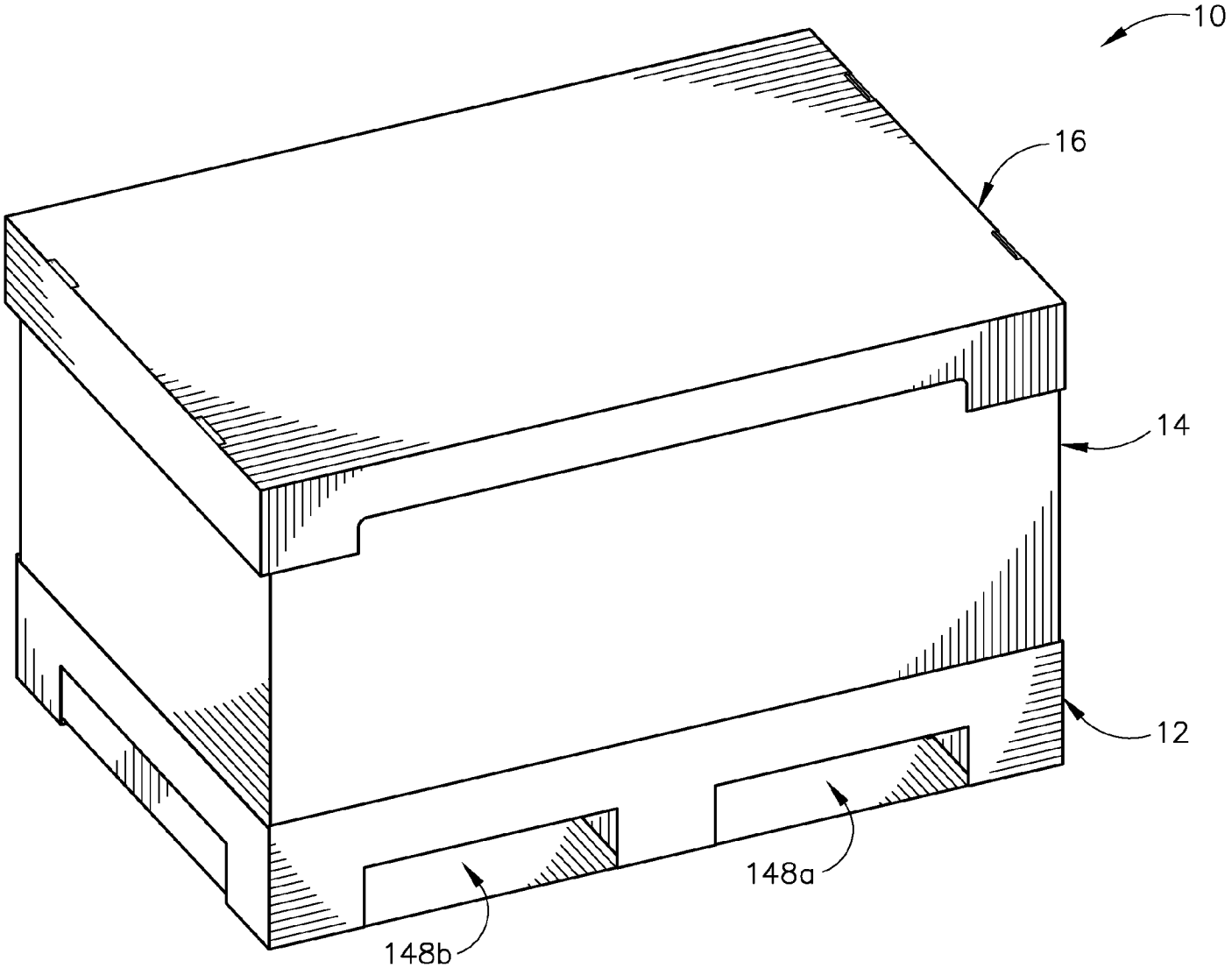
FIG. 21 is a top perspective view of the collapsible bulk bin container shown in FIG. 21 with packed with articles and enclosed.

To erect the collapsed bulk bin container 10, the lid 16 is removed and then foldable sidewall body 14 expands by moving the side wall panel 104*a* away from the foldable tray 12 and pivoting the side wall body flap 116*a* toward the attachment flap 116*b* so that the side wall body flap 116*a* and the attachment flap 116*b* are aligned with one another to form the bottom of the foldable sidewall body 14 and thereby initiating the articulation folds 120, 122 moving away from the interior of the sidewall body 14 and each other as depicted in FIG. 19. When the collapsed bulk bin container 10 is fully erected, the two side wall panels 104*a*, 104*b* are vertically orientated so as to be substantially perpendicular to the pallet runners 18 and the two end wall panels 102*a*, 102*b* being perpendicular to the two side wall panels 104*a*, 104*b* to form a rectangular shaped container. It is contemplated that the side wall body flap 116*a* would maintain its respective position by the weight of the article disposed in the interior foldable sidewall body 14 or otherwise, could be maintained by various locking mechanism. The collapsible bulk bin container 10 may now be filled up by variety of articles 150 by a user as shown in FIG. 20 and completely enclose collapsible bulk bin container 10 by the lid 16 as depicted in FIG. 21.

The collapsible bulk bin container 10 assembly of the present invention avoids the drawbacks of prior art knock down containers, including general structural weakness, loose fitting top cover and bulkiness of shipping. The inventive collapsible bulk bin container 10 assembly has a small footprint when transported or stored empty and folds up or can be assembled rapidly without the use of tools. The knock down bulk bin can be stacked and stored efficiently when in the knocked-down position. When in the knocked-down position, the collapsible bulk bin container 10 provides a convenient and efficient returnable package for customers and is completely recyclable at the end of its effective use cycle. Unlike wooden pallets, the inventive collapsible bulk bin container 10 can be shipped internationally without having to meet lumber treatment standards.

Accordingly, one aspect of the present invention is directed to a collapsible container comprising a foldable tray having a plurality of pallet runner sleeves. A plurality of elongated pallet runners each of which is adapted to be removably inserted into each of the respective plurality of pallet runner sleeves. A foldable side wall body is adapted to rest upon the foldable tray to form an interior space to receive a plurality of articles. A lid is telescopically enclosing the collapsible container. The foldable tray comprises a plurality of fork access openings formed therein to accommodate the tines of a forklift. The plurality of fork access openings are in both opposed side walls of the foldable tray for a two-way entry of the tines of a forklift. The plurality of pallet runner sleeves includes two pallet runner sleeves spaced apart from one another and are integrally formed on respective opposed lateral edges of the foldable tray. Each of the plurality of elongated pallet runners includes an inner support structure integrally formed thereto to enhance lateral strength of each of the plurality of elongated pallet runners. The plurality of elongated pallet runners includes three pallet runners wherein two of which are inserted to the respective plurality of pallet runner sleeves and one of the three pallet runners is disposed in proximity of center of the foldable tray. Both opposed ends of each of the plurality of elongated pallet runners are enclosed. The foldable side wall body comprises end walls, side walls, and side body flaps to form an enclosed bottom thereof and wherein each of the end walls includes an articulation fold formed therein to bisect the respective end wall panels. The foldable side wall body is attached to the foldable tray via an attachment flap. The foldable sidewall body sits inside peripheral boundaries of the foldable tray having a minimum profile. The foldable tray, the plurality of elongated pallet runners, and the foldable side wall body are all formed from corrugated paperboard material.

Another aspect of the present invention is directed to a collapsible shipping container is capable of configured from a collapsed position for storage and transportation to a constructed position for containment of articles therein and back again to the collapsed position after use. The collapsible shipping container comprises a foldable tray having at least two pallet runner sleeves spaced apart from one another and each of which being formed on respective opposed lateral edges of the foldable tray. A plurality of elongated pallet runners each of which having an inner support structure integrally formed thereto. The plurality of elongated pallet runners each of which is adapted to be inserted into each of the respective plurality of pallet runner sleeves. A foldable side wall body is adapted to rest upon the foldable tray to form an interior space to receive a plurality of articles. The foldable side wall body comprises end walls, side walls, and side body flaps to form an enclosed bottom thereof. Each of the end walls includes an articulation fold formed therein so that during the collapsed position, the articulation folds move toward the interior space and during the constructed position, the articulation folds move away from the interior space. A lid is configured to telescopically enclosing the collapsible shipping container.

One further aspect of the present invention is directed to a method for constructing a collapsible shipping container. The method comprising the steps of forming a foldable tray made from a blank B4. The foldable tray has a base wall panel, two side wall panels, and two end wall panels which are formed by two pairs of respective fold lines intersecting one another at right angles. Two pallet runner sleeves are formed between the base wall panel and the two opposed end wall panels. Then, forming a plurality of elongated pallet runners each of which made from a blank B1, the plurality of elongated pallet runners being affixed to the foldable tray, the plurality of elongated pallet runners includes an inner support structure integrally formed thereto and forming a foldable side wall body made from a blank B3, the foldable side wall body configured to be attached to the foldable tray to form an interior space to receive a plurality of articles wherein the foldable side wall body comprises two end walls, two side walls, and side body flaps to form an enclosed bottom thereof wherein each of the end walls includes an articulation fold formed therein so that during the collapsed position, the articulation folds move toward the interior space and during the constructed position, the articulation folds move away from the interior space.

While the invention has been described and illustrated with reference to one or more preferred embodiments thereof, it is not the intention of the Applicants that the invention be restricted to such detail. Rather, it is the intention of the Applicants that the invention be defined by all equivalents, both suggested hereby and known to those of ordinary skill in the art, of the preferred embodiments.

What is claimed is:

1. A collapsible container comprising:

a foldable tray, having opposed front and back wall panels, opposed side wall panels, a base wall panel, and a plurality of pallet runner sleeves formed integrally with the tray and wherein the plurality of pallet runner sleeves each of which is formed between the opposed side wall panels and base wall panel each of the pallet runner sleeves includes a length that is shorter than a respective lateral length of the base wall panel or the opposed side wall panels;

an elongated pallet runner removably inserted into each of the pallet runner sleeves and wherein the elongated pallet runner is foldably constructed so that both opposed ends of the pallet runner is integrally enclosed; and a foldable side wall body being adapted to rest upon the foldable tray to form an interior space to receive a plurality of articles.

2. The collapsible container of claim 1 further comprising a lid telescopically enclosing the collapsible container.

3. The collapsible container of claim 1 wherein the foldable tray comprises a plurality of fork access openings formed therein to accommodate the tines of a forklift.

4. The collapsible container of claim 3 wherein the plurality of fork access openings are in both said opposed side wall panels of the foldable tray for a two-way entry of the tines of a forklift.

5. The collapsible container of claim 1 wherein the plurality of pallet runner sleeves includes two pallet runner sleeves spaced apart from one another and located at opposite sides of the foldable tray.

6. The collapsible container of claim 1 wherein each of the plurality of elongated pallet runners is made from a single blank to form a tubular structure having a bottom wall, a top wall, opposite side walls, opposite end walls, and an integral inner support structure to enhance lateral strength of each of the plurality of elongated pallet runners.

7. The collapsible container of claim 1 wherein the plurality of elongated pallet runners includes three pallet runners, one pallet runner is inserted into each pallet runner sleeve and one pallet runner is disposed in proximity to the center of the foldable tray.

8. The collapsible container of claim 1 wherein the foldable side wall body comprises end walls, side walls, and side body flaps to form an enclosed bottom thereof and wherein an articulation fold bisects each of the end wall panels.

9. The collapsible container of claim 1 wherein the foldable side wall body is attached to the foldable tray via an attachment flap.

10. The collapsible container of claim 1 wherein the foldable sidewall body sits inside peripheral boundaries of the foldable tray having a minimum profile defined by the front and back wall panels and the side wall panels.

11. The collapsible container of claim 1 wherein the foldable tray, the plurality of elongated pallet runners, and the foldable side wall body are all formed from corrugated paperboard material.

12. A collapsible shipping container and pallet combination that can be stored and shipped in a collapsed position, placed in an erected position for containment of articles, and returned to a collapsed position after use, the collapsible shipping container comprising:

a foldable tray having at least two pallet runner sleeves spaced apart from one another and each of which is integrally formed on a respective opposite lateral edge of the foldable tray and wherein each of the two pallet runner sleeves is formed between the opposed side wall panels and base wall panel, each of the panel runner sleeves includes a length that is shorter than a length of the lateral edge of the foldable tray;

a plurality of elongated pallet runners each of which is folded from a single unitary blank to have a tubular construction with an integral inner support structure and with both opposed ends of the pallet runners integrally enclosed and each of which is inserted into a respective one of the plurality of pallet runner sleeves;

a foldable side wall body adapted to rest upon the foldable tray to form an interior space to receive a plurality of articles, wherein the foldable side wall body comprises end walls, side walls, and side body flaps that form an enclosed bottom, wherein an articulation fold is formed in each of the end walls so that in the collapsed position the articulation folds move toward the interior space, and in the constructed position the articulation folds move away from the interior space; and a lid configured to telescopically enclose the collapsible shipping container when it is in its collapsed position.

13. The collapsible shipping container of claim 12 is made from corrugated paperboard material.

* * * * *